US007823991B2

(12) United States Patent
Purdy

(10) Patent No.: US 7,823,991 B2
(45) Date of Patent: Nov. 2, 2010

(54) STORAGE UNIT

(75) Inventor: Paul Douglas Purdy, Twickenham (GB)

(73) Assignee: PDY Systems LP, Gray, TN (US)

( * ) Notice: Subject to any disclaimer, the term of this patent is extended or adjusted under 35 U.S.C. 154(b) by 472 days.

(21) Appl. No.: 11/667,206

(22) PCT Filed: Jun. 26, 2006

(86) PCT No.: PCT/GB2006/002338

§ 371 (c)(1),
(2), (4) Date: May 7, 2007

(87) PCT Pub. No.: WO2006/136858

PCT Pub. Date: Dec. 28, 2006

(65) Prior Publication Data

US 2007/0273255 A1 Nov. 29, 2007

(30) Foreign Application Priority Data

Jun. 24, 2005 (GB) ..... 0512931.7
Dec. 16, 2005 (GB) ..... 0525650.8

(51) Int. Cl.
*E05C 9/10* (2006.01)

(52) U.S. Cl. ..... 312/216; 312/219; 312/902; 312/244; 206/373

(58) Field of Classification Search ..... 206/373, 206/372, 579; 312/330.1, 332.1, 902, 215, 312/222, 244, 216, 217–221, 333
See application file for complete search history.

(56) References Cited

U.S. PATENT DOCUMENTS 1,459,324 A * 6/1923 Diebold ..... 312/334.27

(Continued)

FOREIGN PATENT DOCUMENTS

DE 298 05 365 U1 8/1998

(Continued)

OTHER PUBLICATIONS

United Kingdom Intellectual Property Office Search Report dated Aug. 31, 2005 (1 sheet).

(Continued)

*Primary Examiner*—Mickey Yu
*Assistant Examiner*—Chun Cheung
(74) *Attorney, Agent, or Firm*—Flynn, Thiel & Boutell & Tanis, P.C.

(57) ABSTRACT

A storage unit having a frame, drawers and a carrying handle. When the unit is lifted by the handle, or the handle is moved to a position suitable for lifting the storage unit, the handle arms lift the bottom drawer of the stack of drawers which in turn lifts each of the above drawers relative to the frame. As each drawer rises, the clearance gap between adjacent drawers is reduced and the drawers are moved to a locked position where they are blocked by detents mounted on the inside of the frame. In an alternative embodiment (not shown), the handle is coupled to drawer locking slides instead of the bottom drawer and detents on the drawer locking slides engage with the drawers to lock them in the closed position as the drawer locking slides are moved relative to the frame.

19 Claims, 17 Drawing Sheets

U.S. PATENT DOCUMENTS

| | | | | | |
|---|---|---|---|---|---|
| 1,984,345 | A | * | 12/1934 | Kennedy | 312/290 |
| 2,440,541 | A | * | 4/1948 | Gash | 312/217 |
| 3,005,671 | A | * | 10/1961 | Majeski | 312/216 |
| 3,316,045 | A | * | 4/1967 | Leland | 312/220 |
| 3,439,967 | A | | 4/1969 | Taylor | |
| 3,862,772 | A | * | 1/1975 | Latham | 312/215 |
| 4,118,086 | A | | 10/1978 | Kneier | |
| 4,351,448 | A | * | 9/1982 | Ingersoll et al. | 220/318 |
| 4,501,355 | A | | 2/1985 | Hoffman | |
| 4,775,199 | A | * | 10/1988 | Lanius et al. | 312/220 |
| 4,910,915 | A | | 3/1990 | Sanchez | |
| 5,226,553 | A | | 7/1993 | Fiore | |
| 6,250,730 | B1 | | 6/2001 | Roth et al. | |
| 6,997,527 | B2 | * | 2/2006 | Cheng | 312/332.1 |

FOREIGN PATENT DOCUMENTS

| | | | |
|---|---|---|---|
| EP | 0 254 088 | | 1/1988 |
| EP | 1 520 660 | A2 | 4/2005 |
| GB | 448 216 | | 6/1936 |
| GB | 996 294 | | 6/1965 |
| GB | 1 196 050 | | 6/1970 |
| GB | 2 407 253 | A | 4/2005 |
| WO | WO2004/008912 | A1 | 1/2004 |

OTHER PUBLICATIONS

United Kingdom Intellectual Property Office Search Report dated Mar. 14, 2006 (1 sheet).
International Search Report dated Dec. 4, 2006.
Chinese First Office Action issued in Chinese Application No. 2006/80022540.3, dated Jun. 8, 2010 (9 sheets).

* cited by examiner

STORAGE UNIT

FIELD OF THE INVENTION

The present invention relates to improvements relating to storage units. A storage unit is any unit in which items can be stored. Preferred embodiments of the present invention relate particularly to tool boxes, make-up boxes, boxes for fishing equipment, food storage units, or the like, having trays or drawers in which items may be stored. Particularly preferred embodiments are liftable units with drawers.

BACKGROUND OF THE INVENTION

It is known to provide a storage unit having trays formed as drawers which are configured to slide in and out of a storage unit housing or frame. In this way, when the drawers are opened, materials kept in the drawers can be accessed. If a back wall is provided in the housing, the drawers can only be slid open in one direction. However, if there is no back wall, the drawers can be slid out in either of two opposite directions to allow access to the contents of the drawer. A dividing wall may be provided within the tray to divide the tray into a plurality of compartments. In the case of a tool box, the drawers may be separated into compartments for items such as nuts, screws, bolts, washers etc. To allow the drawers to move in and out of the storage unit, a clearance gap is provided between the top level of the drawer and the surface immediately above the drawer. This gap must be provided to prevent the drawer from sticking as it slides.

There are a number of problems with known storage units of the drawer and frame type.

Storage units of the known drawer and frame type may be provided with locking means. These typically comprise a locking bolt which moves in a direction substantially perpendicular to the drawer open and closing direction. An example of such an arrangement is disclosed in U.S. Pat. No. 4,775,199. A problem is the need to provide complicated locking mechanisms with many moving and/or interconnected parts where a lockable storage unit is desired.

Another problem with storage units of this type is their tendency to jam. Because a clearance gap must be provided to allow the drawer to move, it is possible for items such as nails or screws to become wedged between the inside of the drawer and the drawer housing. This situation may occur when the unit falls over and the tip of the, say, nail comes into contact with the drawer housing. Typically, drawers are housed within individual drawer housings. Due to the presence of a clearance gap between the drawer and the housing, movement of the drawer within the drawer housing may impact upon the nail and cause it to become embedded in the drawer housing. When the unit is righted, the drawer falls to the bottom of the drawer housing, and the tip of the nail remains embedded in the drawer housing whilst the head of the nail contacts the bottom of the drawer. As the drawer is opened, friction between the head of the nail and the interior surface of the drawer causes the head of the nail to be drawn out with the drawer, which in turn causes the tip to become more heavily embedded in the drawer housing.

Another known type of storage unit includes trays that are rotatable around a centre pole of the unit. The trays may be divided by dividing walls into a plurality of compartments. When the trays are arranged one above the other, it is not possible to access items within the trays. Access is provided to items within a tray by rotating the tray relative to an overlying tray. To allow the trays, to rotate relative to one another, clearance gaps are provided between the top tray and a surface immediately above the tray, and also between adjacent trays. The gaps must be provided to prevent a tray from sticking as it rotates.

A problem with storage units of this type, and with drawer storage units of the type mentioned above, is that, if the items stored in the trays are smaller than the clearance gap, it is possible for items stored in a first compartment to move into a second compartment, or even to jump out of the tray altogether. The mixing of items is undesirable as it makes it more difficult to accurately determine where a particular item should be within the storage unit. This problem is particularly evident should the storage unit fall over as this provides an opportunity for many items to be thrown out of their own compartment and to be moved into another.

Another known type of storage unit comprises a plurality of bins that are rotatably mounted on support arms to move from an open position to a closed position. Typical units have a series of bins on either side that fold out to allow access to the bins and also to the interior of the unit. Each bin may be divided into a number of compartments. The unit is opened by pulling on the uppermost bin in a direction generally away from the unit. As the bins are pulled out away from the body of the unit, the support arms rotate and allow successive layers of the bins to become accessible. In this way, a user of the unit can gain progressive access to each of the bins. In a fully opened position, each bin is accessible.

A problem with storage units of this second type is that, because the bins must rotate on the support arms, the bins under the first layer are not easily accessible. For example, if access to the deepest bin is required, it is not possible to go straight to that bin without having to make all the higher bins accessible.

The present invention, in a first aspect, provides a storage unit having a frame, a drawer moveable, in a first direction in and out of the frame between a closed position within the frame and an open position in which the drawer projects from the frame, and a locking control member for selectively locking the drawer in the closed position, wherein a linkage is provided between the locking control member and the drawer for displacing the drawer relative to the frame.

The inventor has appreciated that providing a linkage of this type allows one to produce storage units which can achieve one or more of: (a) automatic locking; (b) elimination of fiddly locking mechanism; (c) reduced risk of drawer jamming; and/or (d) reduced risk of items escaping from a drawer or drawer's compartment.

Preferably, the drawer is respectively unlocked and locked against movement in the first direction and moves relatively to the frame in a second direction between unlocked and locked positions. This has the advantage that the relative movement in the second direction effects locking and unlocking so that additional complicated, external and/or fiddly locking mechanisms are not required.

In a preferred embodiment of the invention the drawers move in a first substantially horizontal direction between open and closed positions and the closed drawer or drawers more relative to the frame in a vertical direction.

The inventor has appreciated that such an arrangement allows one to use the action of lifting the storage unit to power or provide the energy required for effecting the movement of a drawer or drawers in the direction perpendicular to their direction as opening and closing. The inventor has appreciated that the highly counter-intuitive step of locking a storage unit by moving the heavy drawer or drawers rather than simply moving a lighter locking bolt is in fact more efficient than moving the bolt in situations where one is lifting the unit anyway.

Preferably, the locking control member for moving the drawer and frame relative to each other comprises a lever or arm coupled or linked to the drawer and/or frame. This allows for easy and controlled movement' of the drawer relative to the frame.

Preferably, the lever or arm is a carrying or lifting handle for carrying or lifting the storage unit. This has the advantage that gravity can be used to help effect vertical relative movement of the frame and drawer by simply picking up the unit.

Preferably, the drawer has a base and a plurality of walls, the top of the walls being separated from an engaging surface by a clearance gap and wherein the means for moving the drawer relatively to the frame moves the drawer into and out of a position in which at least one wall of the drawer is engaged with the engaging surface to eliminate the clearance gap between that wall and the engaging surface. By eliminating the clearance gap, one significantly reduces the possibility of items stored in the drawer escaping or moving from one compartment of the drawer to another (or to outside the unit).

The present invention, in a second aspect, provides a storage unit having a frame, a drawer moveable in a first direction in and out of the frame between a closed position within the frame and an open position in which the drawer projects from the frame, a handle for carrying the storage unit, and a drawer locking element for selectively locking the drawer in the closed position, wherein a linkage is provided between the handle and the drawer locking element to lock the drawer by lifting the unit.

The invention, in its second aspect, helps the drawer remain locked in the closed position during lifting and carrying of the storage unit. This reduces the possibility of items falling from the drawer as a result of it being left open or unlocked during lifting and/or carrying of the storage unit.

BRIEF DESCRIPTION OF THE DRAWINGS

Embodiments of the invention will now be described by way of example with reference to the figures in which.

DETAILED DESCRIPTION

Figure 1A:
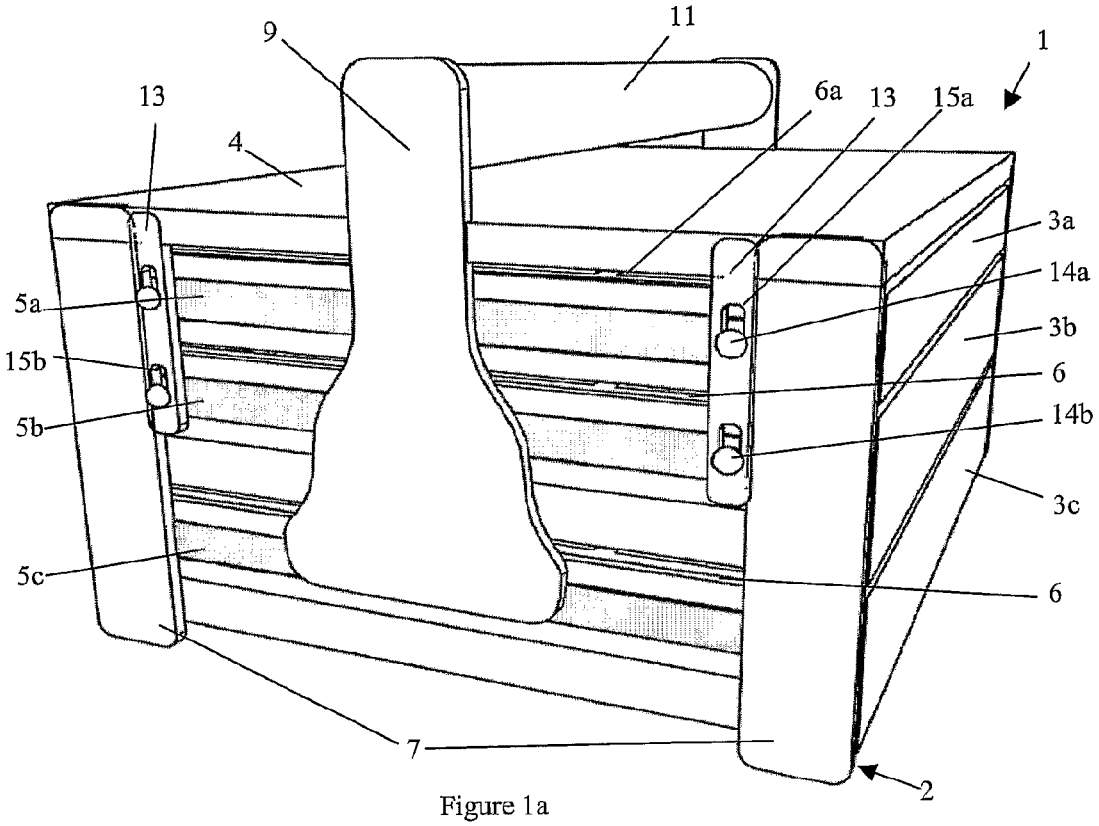
FIG. 1*a* is a perspective view of a first embodiment of the invention in a closed but unlocked configuration.

The unit 1 shown in FIG. 1*a* has a frame 2 including an upper wall 4 supported on four legs 7. The unit also has a plurality of pairs of horizontal rails 5*a*, 5*b*, 5*c* (only one rail of each pair is visible in FIG. 1*a*—the other rail of each pair being on other blind or unshown side of the unit). Mounting brackets 13 are attached to the upper wall 4 of the unit. Stubs 14*a*, 14*b* attached to the rails except the lowest extend through slots 15*a*, 15*b* in the mounting brackets 13 and permit the rails to be hung from the top of the storage unit, held up by the engagement of the stubs in the slots in the mounting brackets 13. Each pair of rails 5*a*, 5*b*, 5*c* slidably supports a drawer 3*a*, 3*b*, 3*c* having a base and sidewalls. The drawers may be divided into a number of compartments by dividing walls. As shown, the rails are formed as projections extending into the unit, although they could take the form of recesses within bodies, mounted on the exterior of the unit, for providing a rail surface to support a drawer. The drawers 3 are separated one from another by a clearance gap 6. A clearance gap 6*a* is also provided between the top drawer 3*a* and the upper wall 4 of the unit 1. In this way, the drawers 3 can be easily opened to allow items separately stored within the unit 1 to be accessed.

Alternatively, if the unit has more than one drawer, the lower drawers could be successively hung via a mounting bracket attached to overlying drawers.

The drawers 3 are constructed to slide in and out of the unit on drawer runners (not shown) on the rails 5*a*, 5*b* and 5*c*. Preferably, the runners are formed either as projections away from the wall of the drawer, or as recesses in the drawer. Alternatively, the rails and drawer runners may comprise roller bearings or the like to allow the drawer to slide into and out of the unit. A combination of these two arrangements could also be used.

The legs 7 prevent the lowest drawer 3*c* from contacting a supporting surface. The lowest pair of rails 5*c* are attached or linked by arms 9 to a handle 11 extending over the top of the unit.

When the drawers are closed and the unit is lifted by the handle 11, the bottom drawer 3*c* is lifted by lifting of the arms 9 connected to the bottom rails 5*c* thereby lifting the drawer 3*c* to bring a wall of the drawer 3*c* into contact with the undersurface of the middle drawer 3*b*. Continued upward displacement of drawer 3*c* causes a wall of the middle drawer 3*b* to be brought into contact with the bottom of the upper drawer 3*a*. Eventually, a wall of the top of upper drawer 3*a* is brought into contact with the upper wall 4 of the unit 1.

Figure 1B:
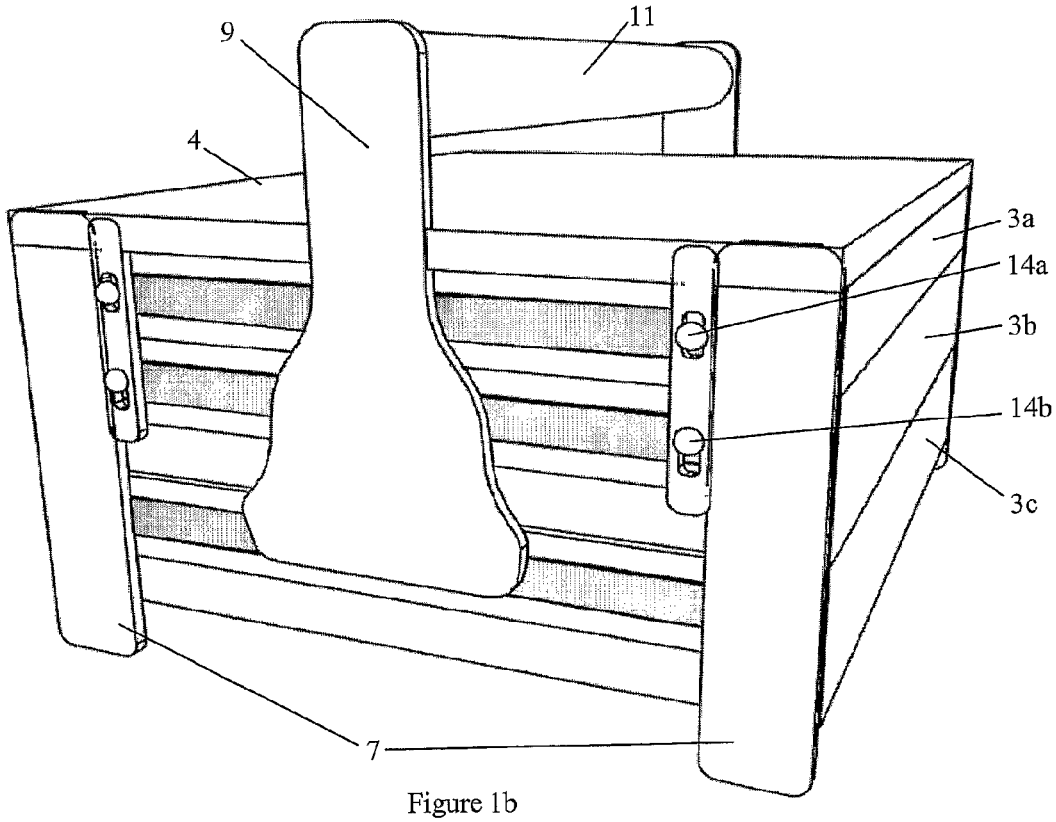
FIG. 1*b* shows the unit of FIG. 1*a* in a closed and locked configuration.
Figure 2A:
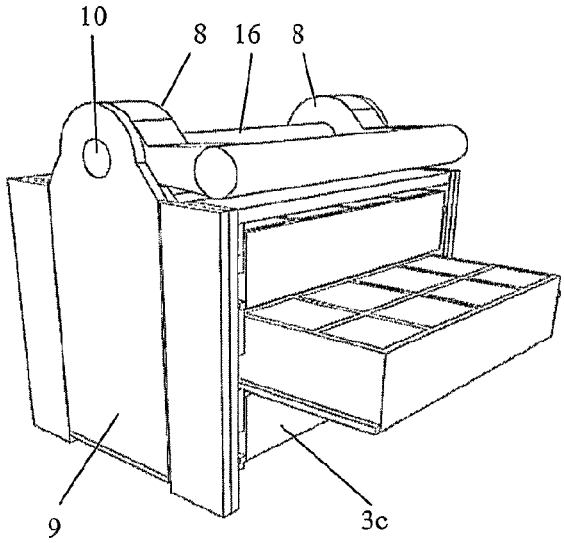
FIGS. 2*a* to 2*d* are perspective views of a second embodiment of a unit according to the present invention being brought from an opened configuration (FIG. 2*a*), through a closed and unlocked configuration (FIG. 2*b*) to a locked carrying configuration (FIG. 2*c*) and finally a locked storage configuration (FIG. 2*d*)
Figure 2B:
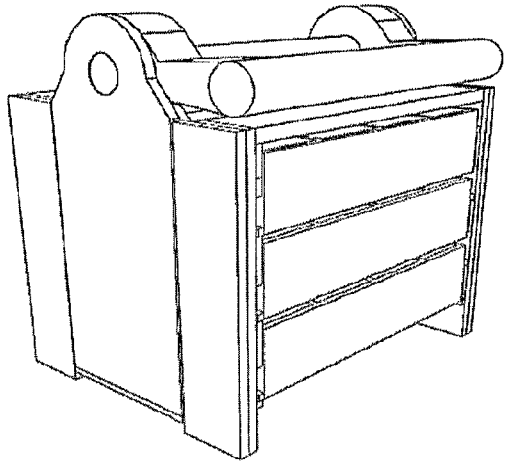
Figure 2C:
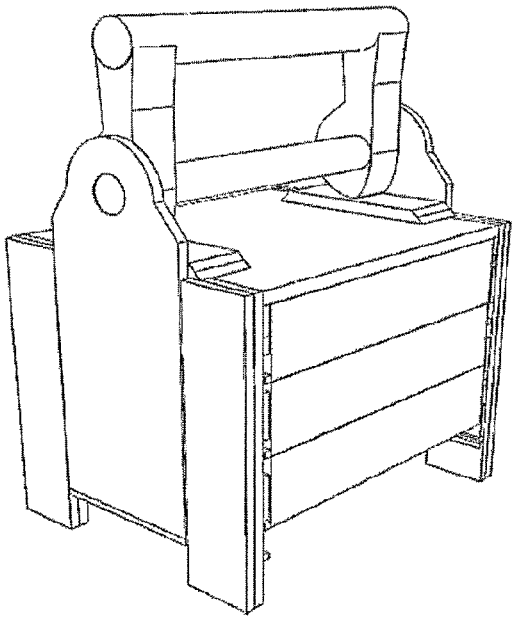
Figure 2D:
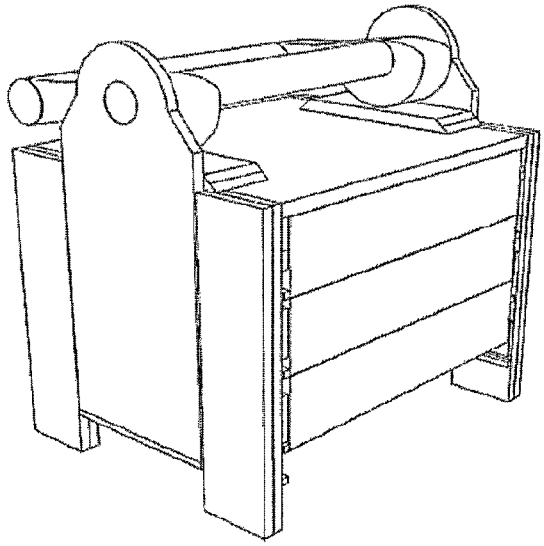
Figure 3:
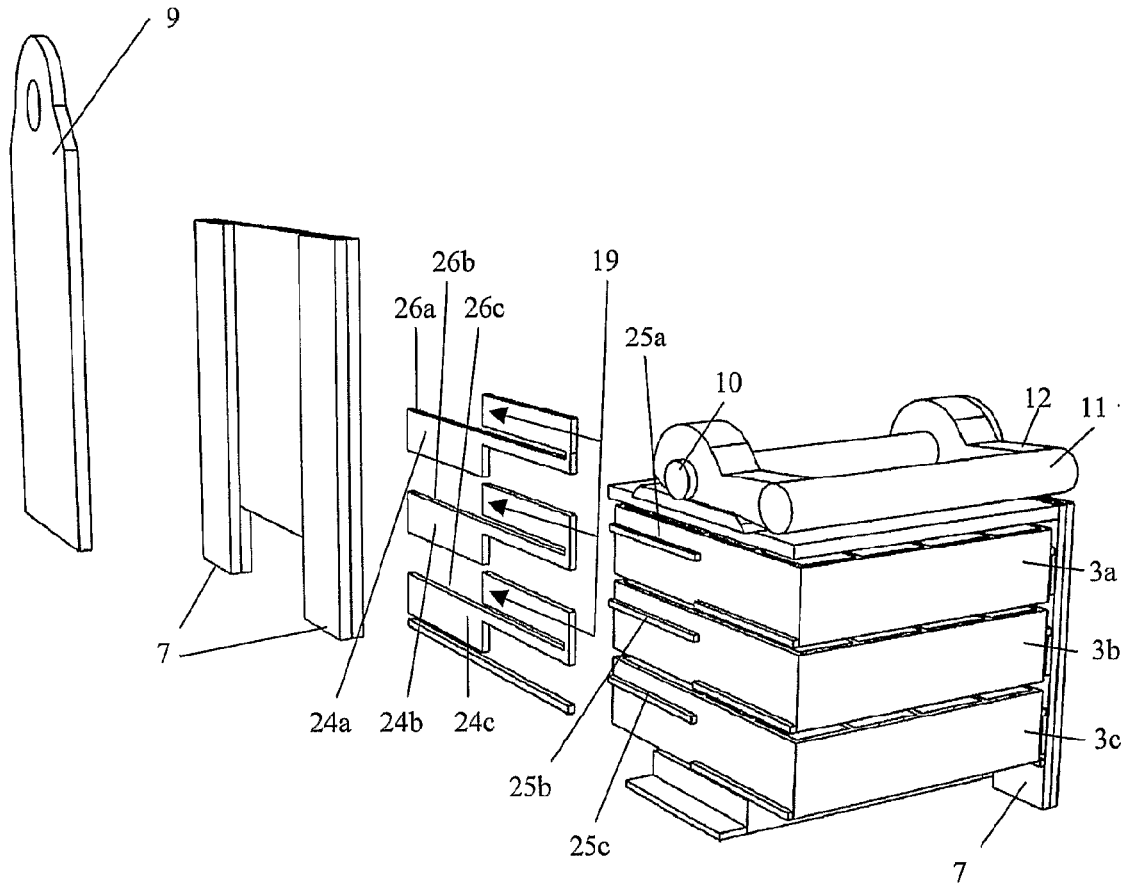
FIG. 3 is an exploded view of the drawer supporting and locking mechanisms of the unit of FIGS. 2*a* to 2*d;*

The handle allows the unit to be carried in this closed configuration (i.e. with the drawers held shut, and with the clearance gaps (6, 6*a*) eliminated), as shown in FIG. 1*b*. The drawers 3 may also be held in the closed configuration by a securing means such as a clasp, catch or lock (not shown). The securing means may be provided within the handle.

As the clearance gaps (6, 6*a*) between drawers 3 and between the upper drawer 3*a* and the upper wall 4 have been reduced or eliminated, the risk of items escaping from the drawers 3 is reduced. Furthermore, provided that the drawer is not so overfilled that items extend above the height of the drawer, it is no longer possible for the drawer to act to embed items in the drawer housing or, in this embodiment, the undersurface of the drawer above.

In a modified embodiment, the bottom drawer 3*c* can be mounted on a runner which is formed as a projection on the inner surface of the side-wall of the unit 1, and the arms 9 are engageable with the underside of the drawer 3*c*. By lifting the handle 11, the arms 9 are brought into engagement with the undersurface of the drawer 3*c* which moves the drawer runner out of contact with rail 5*c* and causes a wall of the drawer 3*c* to come into contact with the undersurface of drawer 3*b*. In this way, the drawers 3 can be successively brought together and the clearance gaps eliminated. Alternatively, the rails may be of the intermediate type that are slidably mounted to a fixed surface and which support a drawer unit by partially extending with the drawer unit as the drawer unit is drawn out.

The unit of FIG. 1 lifts the drawers directly when the unit is picked up by the handle 11. It is also possible to provide a pivotable handle (see FIGS. 2*a*-2*d* and 3) in which a cam arrangement moves and locks (or unlocks) the arms 9 (and hence the drawers 3*a*, 3*b*, 3*c*) as the handle rotates.

In the arrangement of FIGS. 2*a*-2*d* and 3 a handle 11 is coupled to the bottom drawer 3*c* of a set of drawers 3*a*, 3*b*, 3*c* via a cam 8 (coupled to handle 11 via handle extension 12) and a pair of arms or links 9 are slidably guided on each side of the frame and connected to the bottom of the bottom drawer 3*c*.

In the embodiment of FIGS. 2*a*-2*d* and 3, runners 24*a*, 24*b*, 24*c* are attached to the side walls 7 of the storage unit frame to define frame runner tracks with detents or abutments. Drawer runners 25*a*, 25*b*, 25*c* mounted, respectively, on the sides of each of the drawers 3*a*, 3*b*, 3*c* run along the runner tracks defined by the surfaces 26*a*, 26*b*, 26*c* of frame runners 24*a*, 24*b*, 24*c* to open and close the respective drawers. When the drawers are in the closed position and are lifted relative to the frame and its side walls 10, the drawer runners move into a position where their ends abut the detents or abutments 19 of the unit runners 24*a*, 24*b*, 24*c* so that horizontal movement of the drawers is prevented. This is the locked configuration. The drawers are locked against horizontal movement until they are lowered so that their runners again lie on the respective runner tracks or surfaces 26*a*, 26*b*, 26*c*.

A securing means such as a catch, clasp or lock may additionally be provided to help hold the cam 8 in position when the drawers are in the closed configuration. The securing means may be either attached to, or provided within, the handle 11 to prevent the cam 8 from rotating. Furthermore, in preferred embodiments of the present invention, the drawers 3 are held in the closed configuration when the unit is picked up by the handle 11.

In a further alternative arrangement, a door may be provided to cover the front of the drawers 3 to prevent the drawers from opening. The closing of the door activates a mechanism, such as a cam or lever, that causes the drawers to be brought together in the manner described above, and the unit to be held in the closed configuration. In this way, the drawers are prevented from opening and the clearance gaps are eliminated.

Figure 4A:
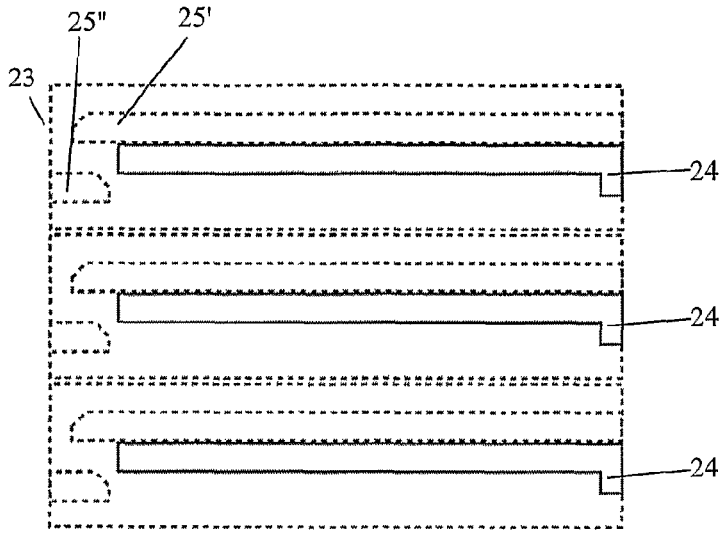
FIG. 4*a* is a sectional view illustrating an alternative drawer moving and locking mechanism with the drawer in a closed and unlocked configuration.
Figure 4B:
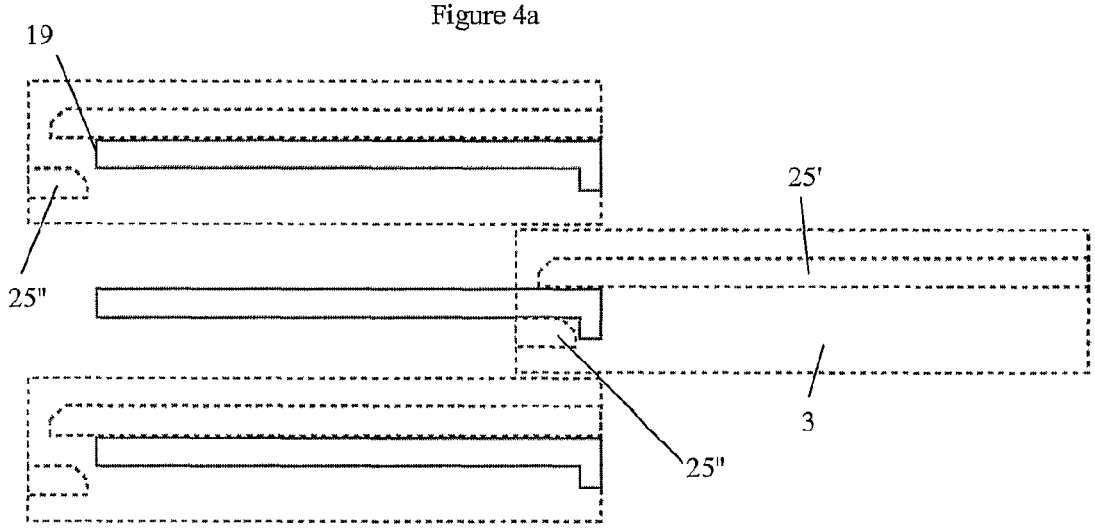
FIG. 4*b* shows the tray of FIG. 4*a*, with the contents of the tray accessible.

FIGS. 4*a* and 4*b* show an alternative runner construction tray or drawer 3. The drawers 3 of FIG. 4*a*, 4*b* are configured to be openable to only one side of the storage unit 1 by virtue of the presence of the back wall 23 of the unit. The drawers 3 are provided with drawer runners 25', 25" which are configured to engage with the unit rails or runners 24 of the unit to allow the drawer 3 both to slide into and out of the unit, and, when the drawer is closed, to move within the unit in a direction substantially perpendicular to the sliding direction. A drawer 3 as shown in FIGS. 4*a* and 4*b*, has upper and lower drawer runners 25' and 25" which slide against, respectively, upper and lower surfaces of the unit runners 24.

Each runner 24 includes a detent or abutment 19 such that, when the drawer has been lifted in the manner described above in connection with the previous figures, if an attempt is made to open the drawer, an end surface of lower drawer runner or rail 25" engages with the detent 19 to prevent the drawer being removed from the unit. The unit runner 24 including the detent 19, may take the form of an L-shape (see FIGS. 4*a*, 4*b*). However, the detent 19 may also be formed separately of the runner 24.

In the arrangement of FIGS. 4*a*, 4*b* the upper drawer runner 25' must be of such a length that the combined length of the upper drawer runner 25' and the lower drawer runner 25" is less than the total length of the drawer 3. In this way, when the drawer 3 is raised, lower drawer runner 25" is not obstructed by the unit runner 24.

Figure 5A:
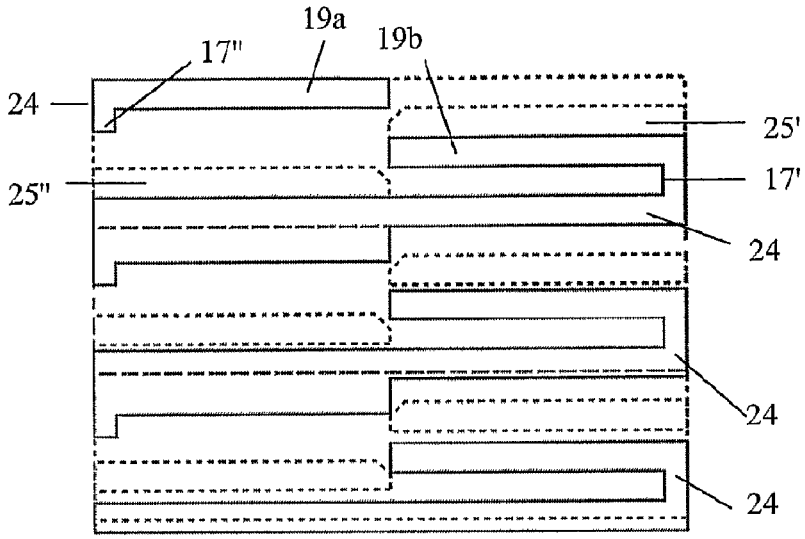
FIG. 5*a* is a sectional view illustrating a further alternative drawer moving and locking mechanism of a tray according to a second aspect in a closed and locked configuration.
Figure 5B:
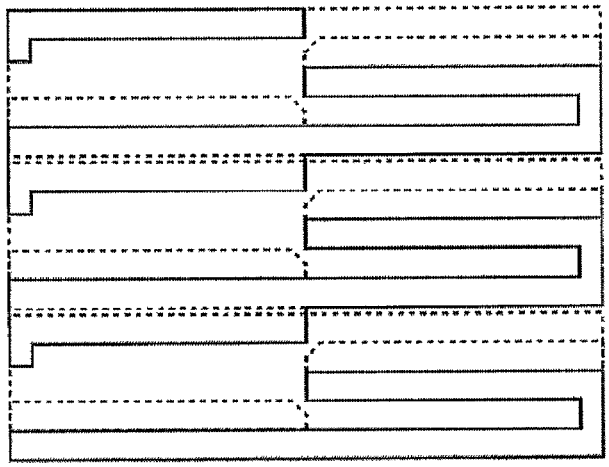
FIG. 5*b* shows the tray of FIG. 5*a* in a closed and unlocked configuration.
Figure 5C:
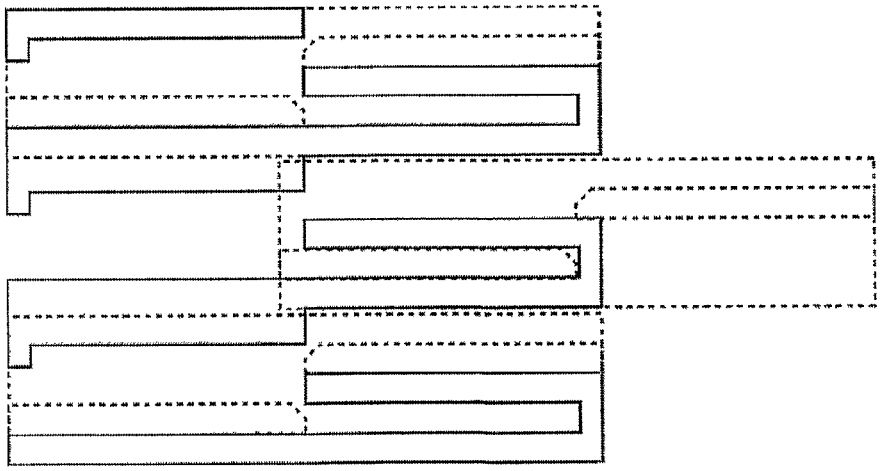
FIG. 5*c* shows the tray of FIG. 5*a*, in an open configuration in which the contents of the tray are accessible.
Figure 6:
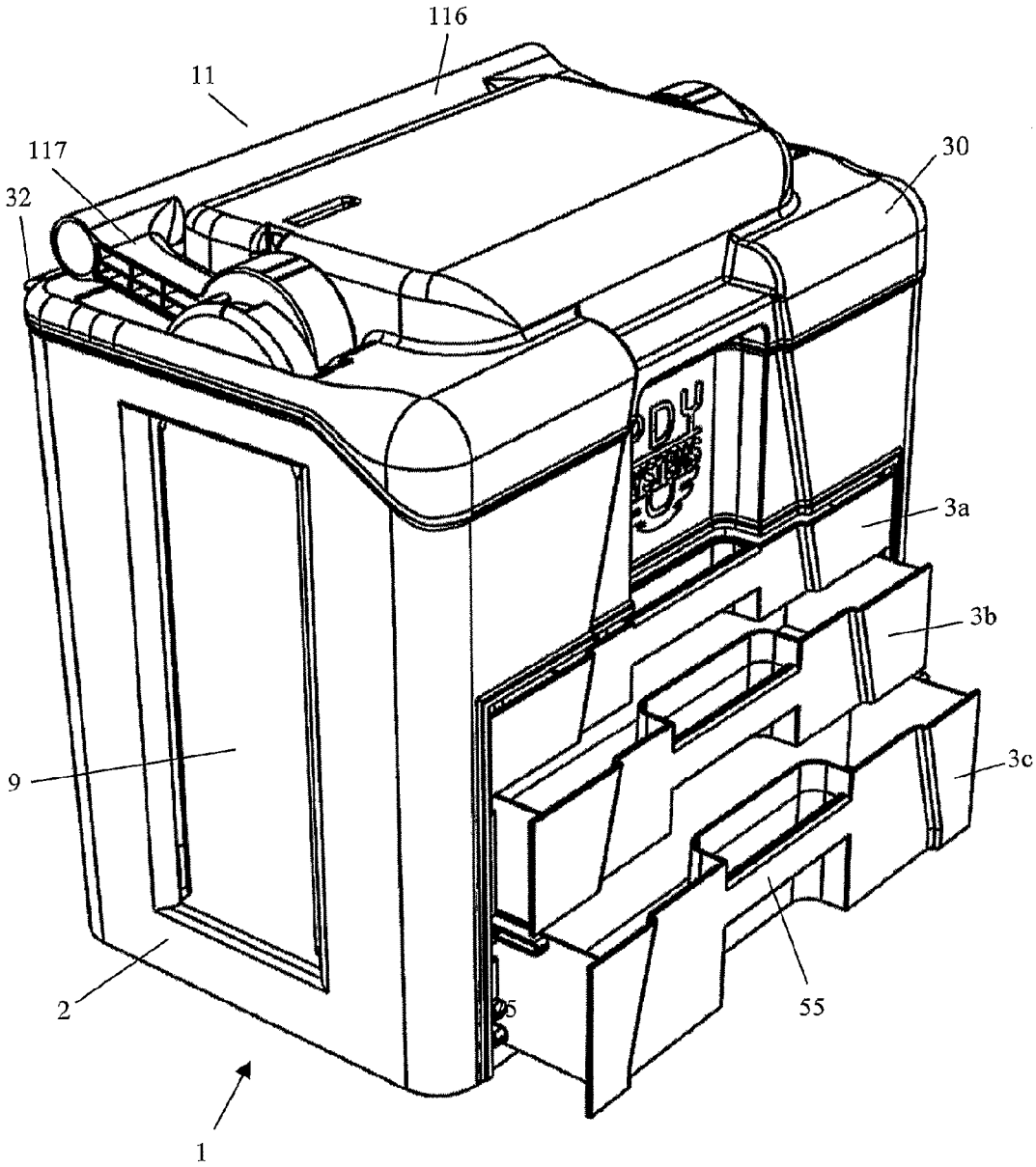
FIG. 6 is a perspective view of a third embodiment of the invention.

A drawer and runner arrangement in which the drawers may be opened from either side or end of the unit is illustrated in FIGS. 5*a* to 5*c*. The drawers of FIGS. 5*a* to 5*c* are configured such that approximately 50% of the drawer remains within the unit at all times. The frame runners 24 include upper and lower detents 17 and 17". To prevent the drawer 3 from opening by more than 50%, either upper drawer runner 25' engages detent 17" when the drawer is opened to a first side of the unit, or lower rail 25" engages detent 17' when the drawer is opened to a second side of the unit. When the drawers 3 are to be held together in the closed configuration, the upper and lower drawer runners are moved substantially perpendicularly with respect to the unit runners. When the drawer is in its raised position as shown in FIG. 5*a*, the end surface of the upper drawer runner 25' opposes a locking detent 19*a* of the unit runner 24, and the end surface of the lower runner rail 25" opposes a locking detent 19*b* of the unit runner 24. In FIGS. 5*a* to 5*c*, the locking detents 19*a* and 19*b* are formed as part of the unit runner 24. They could however be separate elements.

The two arrangements of frame runners 24 and drawer runners 25 shown in FIGS. 4*a*, 4*b* and 5*a*-5*c* are by way of example only. Any other arrangement could be used which allows a drawer to slide in and out of the unit and which allows the clearance gap between the first drawer and a second drawer, or between the first drawer and the upper wall 4 of the unit, to be eliminated when the drawers are in a closed position.

The storage unit illustrated in FIGS. 6 to 14 includes a frame 2, three drawers 3, a lid 30 and a lid compartment 31. The lid 30 is hinged to the storage unit 1 at the back of the lid by a hinge 32. The unit includes a handle assembly 11 and arms 9 (only one shown) linking the handle assembly to the bottom drawer 3*c*. Rotation of the lid about the hinge to an open position from its axis allows access to the contents of the top compartment 31 (see FIG. 9).

In the following discussion, the front of the storage unit is defined by the front face of the drawers with drawer handles and the rear of the storage unit is defined by the position of the hinge.

To move the storage unit, a user grips the handle 11 and rotates it from a horizontal position at the rear of the lid to a vertical position (not shown) suitable for carrying the unit. The unit can then be lifted by the handle assembly. Rotating the handle assembly to the vertical carrying position raises the arms 9 and the bottom drawer 3*c* linked thereto. Raising the bottom drawer raises the two drawers above it and thereby locks the drawers and reduces the clearance between drawers.

Figure 7:
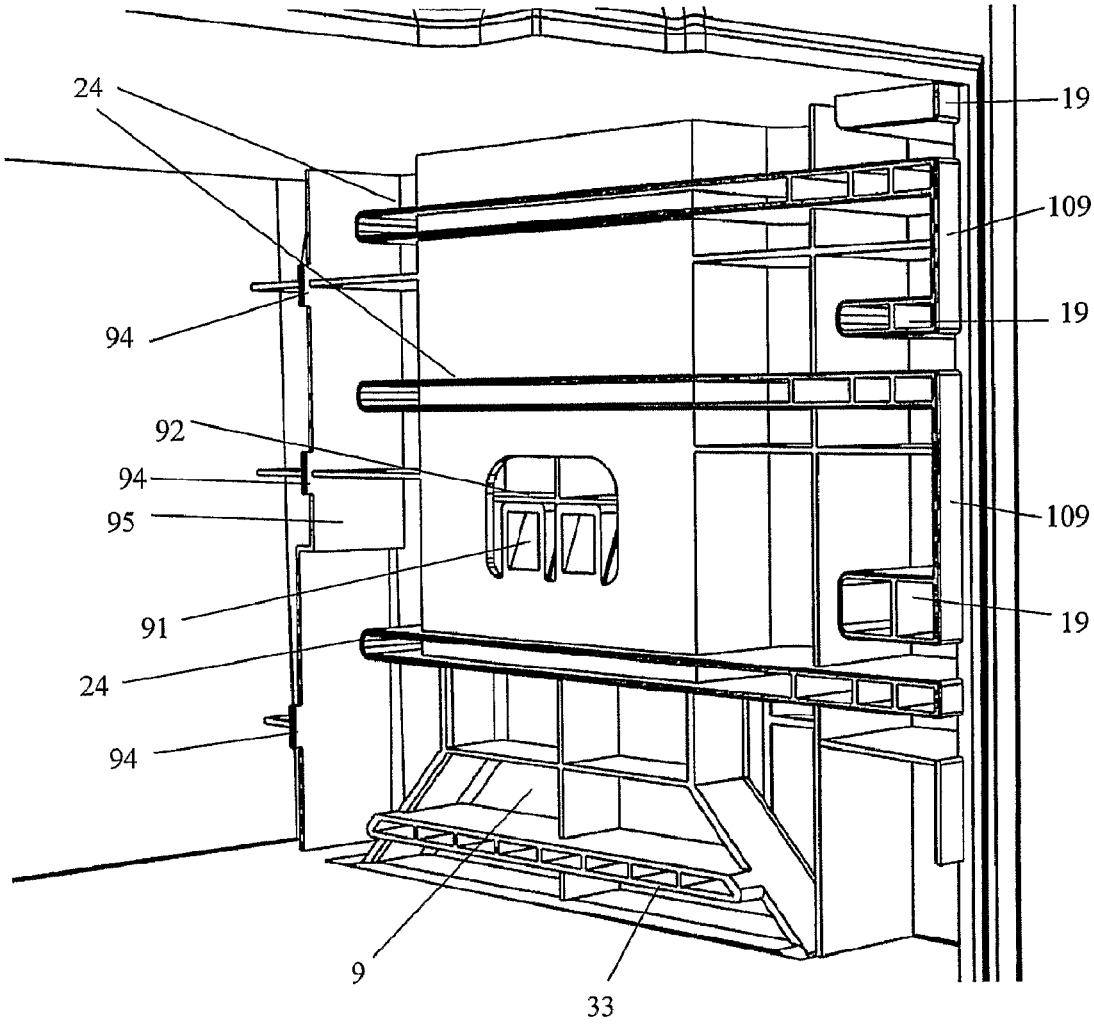
FIG. 7 is a view of the inside of the unit of FIG. 6 with the drawers removed.
Figure 8:
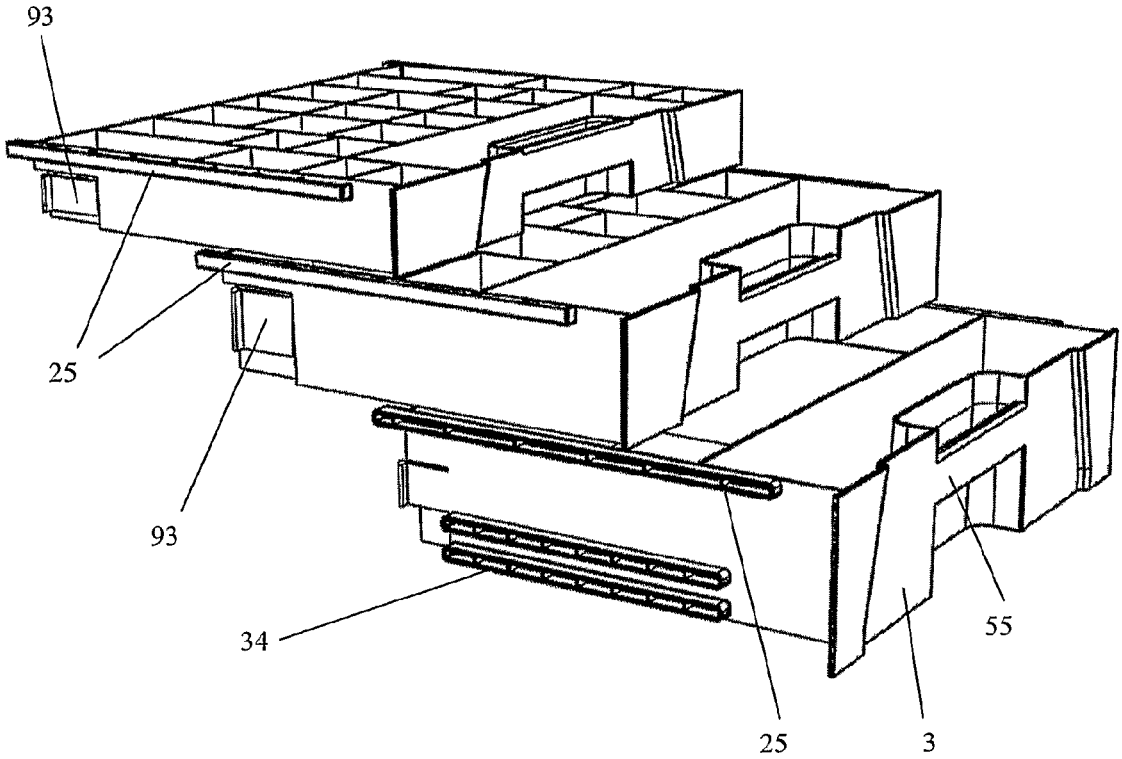
FIG. 8 is a view of the drawers for insertion in the unit of FIGS. 6 and 7.
Figure 9:
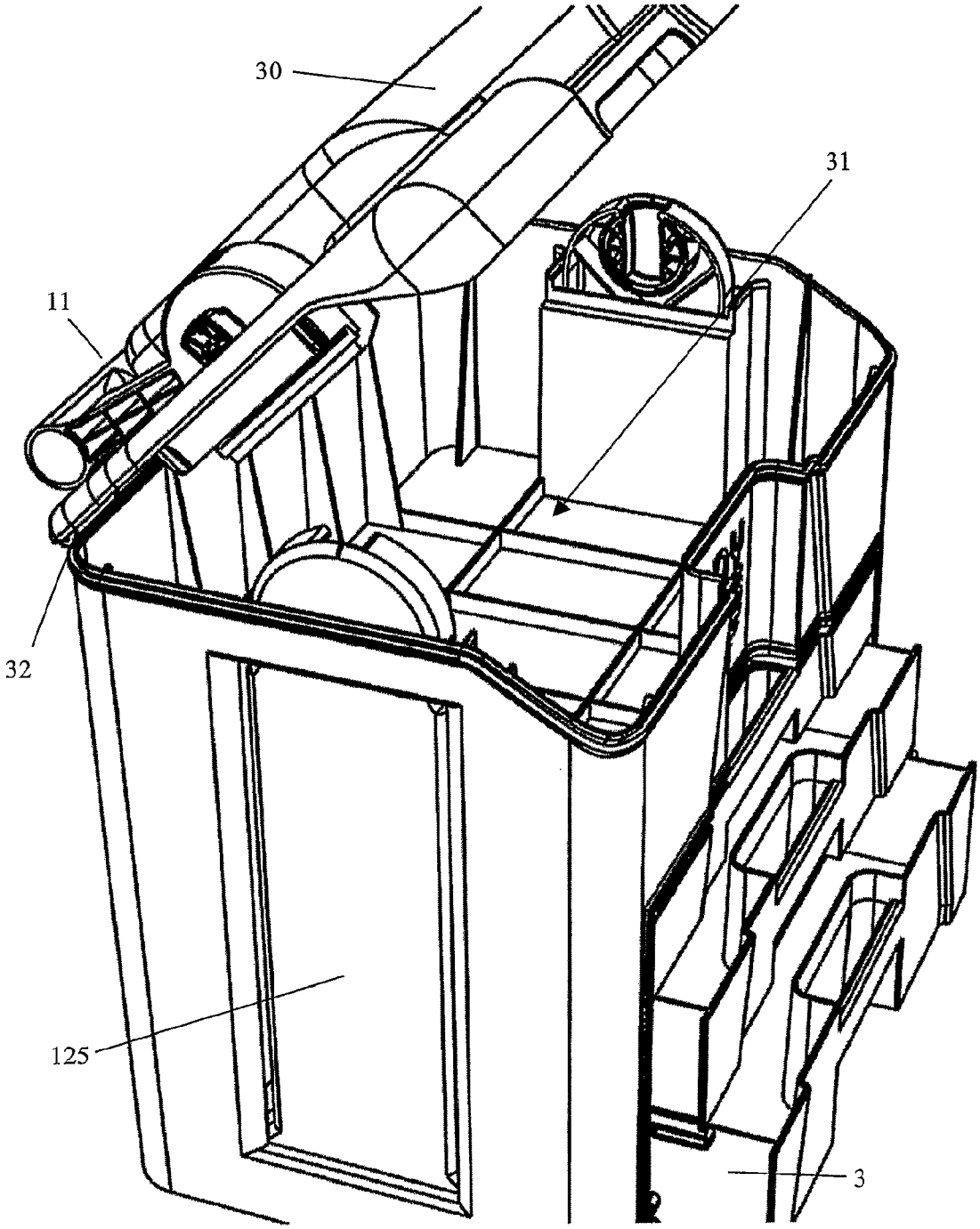
FIG. 9 is a perspective view of aspects of the embodiment of FIG. 6 with the lid open.
Figure 10:
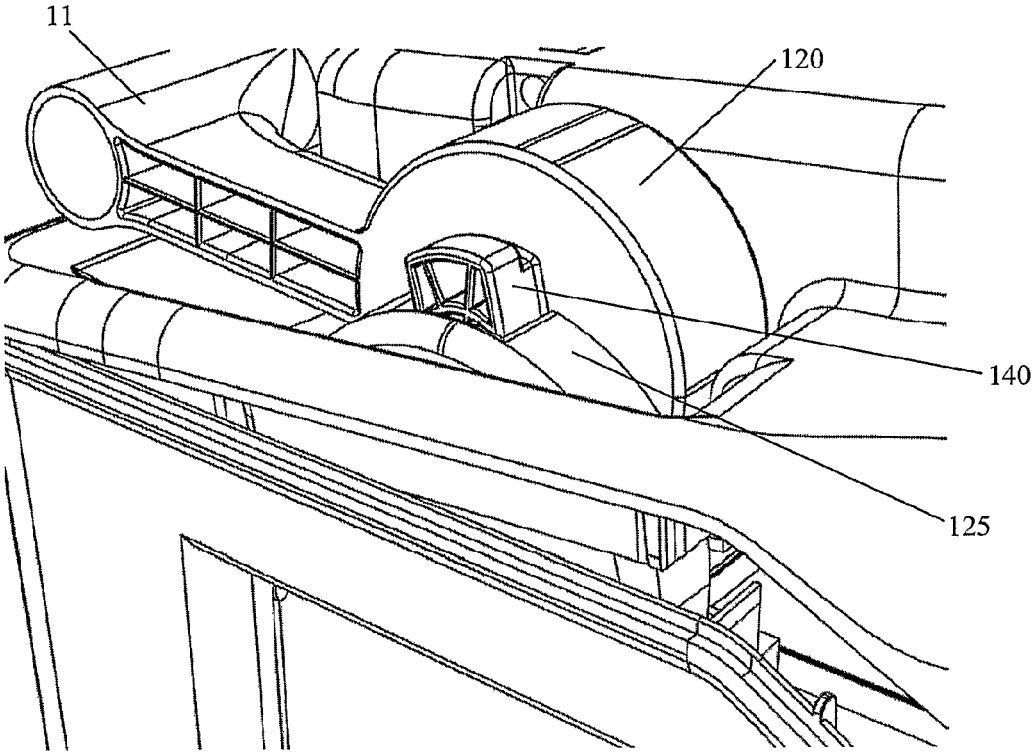
FIGS. 10 and 11 are detailed views of the handle pivot of FIG. 6 illustrating aspects of its operation.
Figure 11:
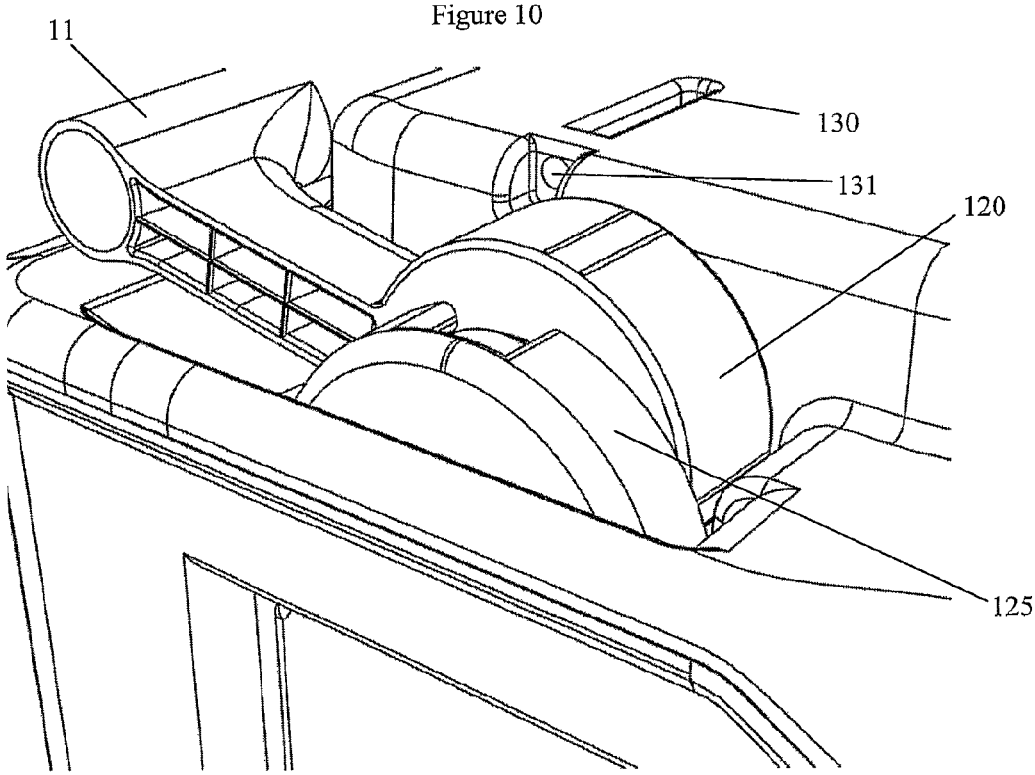

As shown in FIG. 7, the bottom of each arm 9 includes a runner projection 33 which engages between two corresponding runners or projections 34 on the bottom drawer (see FIG. 8). Lifting of the arm 9 lifts the projection 33 on it and therefore also lifts the projections 34 on the bottom drawer and thereby lifts the bottom drawer 3*c*. Lifting the bottom drawer and thereby lifting the two drawers 3*a*, 3*b* above it raises the drawers from the frame runners 24 on which they rest and brings the drawer upper runners 25 behind locking detents 19 on the front of the frame and thereby prevents the drawers from opening.

The arms 9 are located in channels in the frame 2. Clips 91 attached to the sidewall of the frame (see FIG. 7) contact the lower surface of a strengthening rib 92 on the interior surface of the arm 9 to locate the arm in its lower or unlocked position. This controls the lowermost position of the runner projection 33 at the bottom of each arm 9 so that when the arm is in the unlocked position, the upper drawer runners 25 are clear of the detents 19 and the drawers are capable of movement between the open and closed positions.

The drawers 3 (see FIG. 8) have drawer runners 25 which slide along a top surface of frame rails or runners 24 mounted to the inside face of the frame 2. These sets of rails enable the drawers to slide in and out of the frame between a closed position and an open position. Drawer handles 55 are provided on the drawer fronts to enable the user to grip the required drawer.

Drawer stops 109 (see FIG. 7) abut the inside face of the drawer front when the drawers 3 are moved into the closed position. Retaining clips 93 at the rear of each drawer impinge on the drawer stops when the drawers are opened to the fully open position to prevent them from falling out of the frame. In the fully closed position, the retaining clips are clipped onto tabs 94 on a rib 95 projecting from the sidewall of the frame. This prevents the drawers from sliding open under their own weight when the storage unit is left in the unlocked position on an inclined surface.

The handle assembly 11 (see FIG. 6) comprises a grip portion 116 and arms 117. The handle assembly 11 is attached to the lid 30 by pivots 127 (see, e.g., FIG. 13) projecting from the inside face of the handle arms or extensions 117. The pivots 127 are slidably supported by handle supports 161 (see FIG. 14), attached to a side surface of the lid 30. To assemble the storage unit, the arms 117 of the handle 11 are urged apart so that the pivot 127 on each arm 117 can be clipped underneath the outwardly projecting lip of the handle support 161. The handle supports 161 enable the pivots 127 to slide up and down while maintaining the handle assembly in attachment with the storage unit.

As the lid 30 is rotated about the hinge 32 from the partially open position (see FIG. 10) into the closed position (see FIG. 11), a lid looking element 140, attached to the outside face of each handle arm 117, is received by a correspondingly shaped hole or slot 152 in a rotor 145 (FIGS. 12 and 13), located in each arm 9. The lid locking elements 140 are tapered to allow them to slide more easily into the correspondingly shaped hole 152 in the rotors 145.

The rotor 145 is mounted in a recess or slot 153 in each arm 9 (FIGS. 12 and 13) so that it can rotate against the inside curved surface 154 and the inside flat surface 151 of each recess 153. The rotor 145 is axially located against the inside flat surface 151 of the recess 153 in the respective arm 9 by retaining clips 146.

Figure 14:
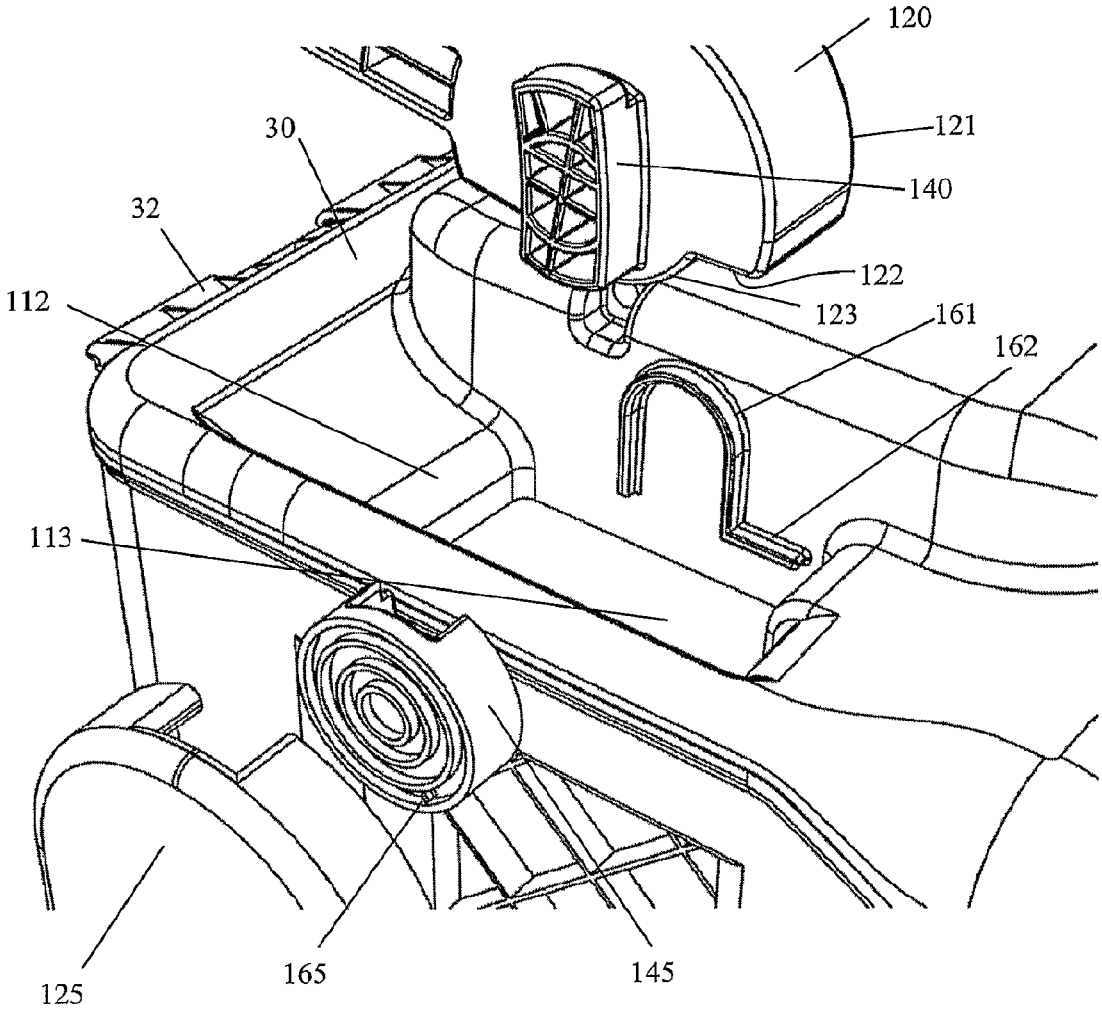
FIG. 14 is an exploded view of the handle pivot of FIGS. 10 and 11 illustrating aspects of its operation.

A cam 120 is integrally formed with each arm or extension 117 of the handle assembly 11 (see FIG. 14). As the handle assembly 11 is rotated, each cam rotates in a well 112 formed in the lid 30. The cam follower is a region 113 of the top surface of the lid 30. The working surface of the cam is maintained in contact with the cam follower 113 as the handle is rotated.

Each cam 120 comprises two curved portions 121, 123, separated by a flat portion 122 (see FIG. 14). The curved portions are segments of a circle and curved portion 123 has a larger radius than curved portion 121.

When the handle assembly 11 is in a horizontal position at the back of the lid, which shall be referred to as position 1, (see FIG. 11), the smaller radius curved portion 123 of each cam 120 is in contact with the respective cam follower region 113 of the lid 30. In this configuration, the pivot 127 on each handle arm 12 is at its lowermost position in the respective handle support 161 and the arms 9 are in the lower or unlocked position.

Figure 12:
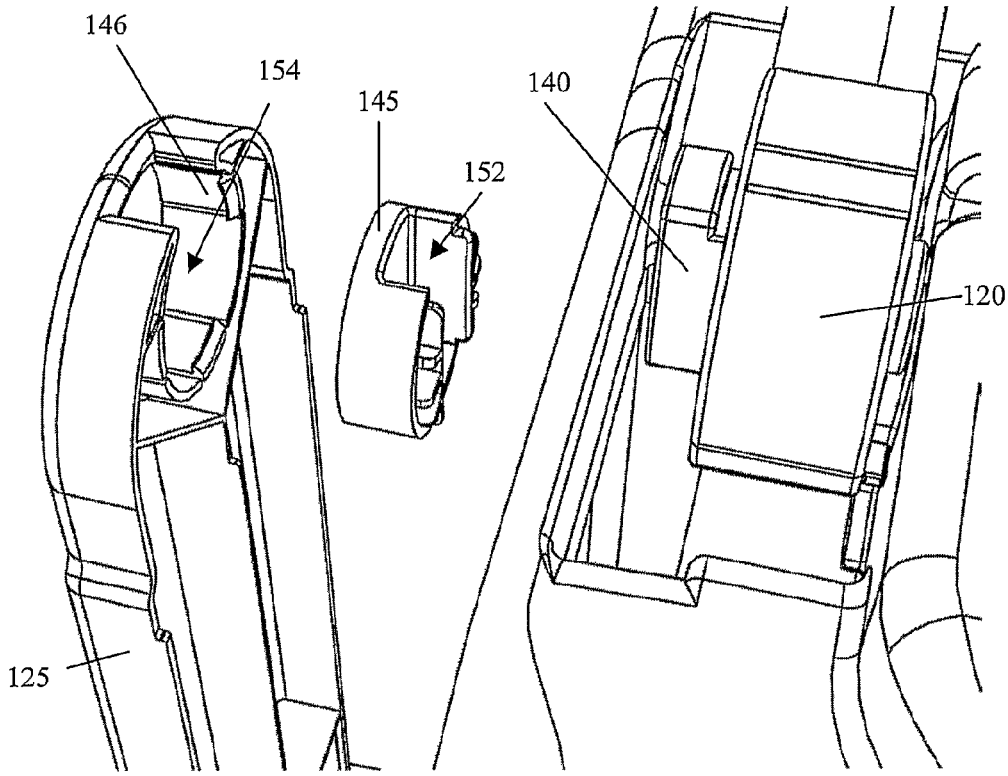
FIGS. 12 and 13 are exploded views of aspects of the linkage between the handle locking control element of FIG. 6 and the drawer illustrating aspects of its operation.
Figure 13:
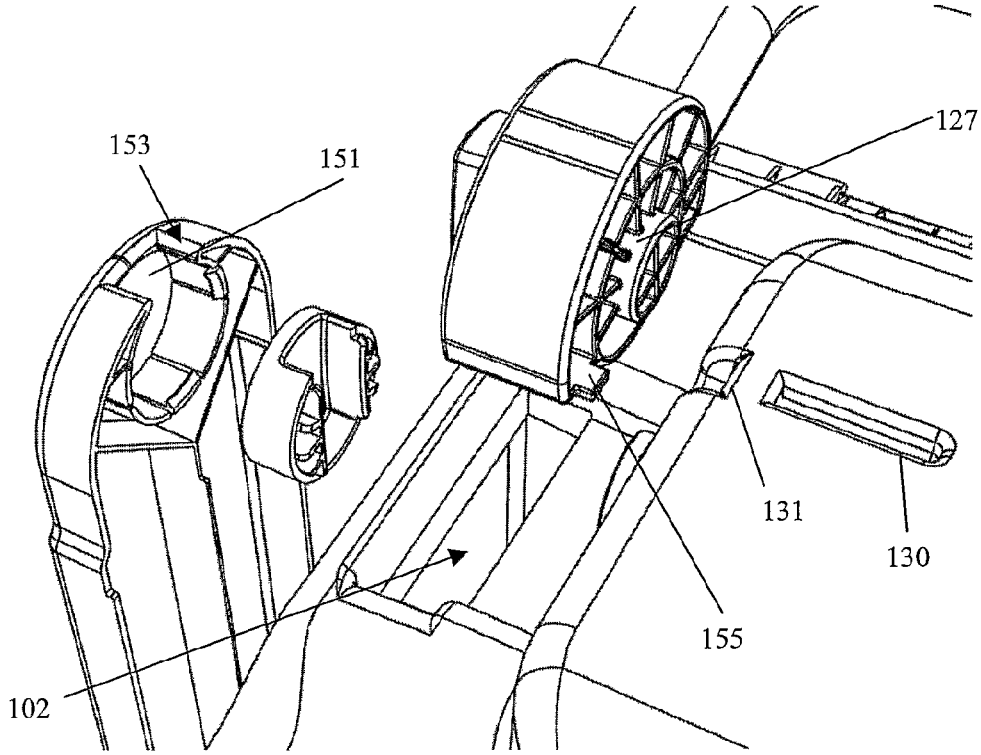

In handle position 1, the slot 152 in each rotor 145 coincides with the slot 153 in the respective arm 9 (see exploded view shown in FIG. 12). A projection 165 (see FIG. 14) on the back of each rotor 145 is clipped into position between a pair of nodules (not shown) on the inside flat surface 151 of the recess 153. The nodules are spaced apart by the width of the projection 165.

In position 1, the lid is unlocked. The nodules ensure that each time the lid 30 is moved by the user from the open position to the closed position, the slots 152, 153 in the rotor 145 and arm 9 are aligned. This allows the lid locking element 140 to slide into the corresponding hole in each rotor 145 without the danger of the lid locking element 140 being obstructed by misalignment of the slots.

In position 1, a tab 155 on the inside face of the cam 120 (see FIG. 13) abuts the lower surface of the horizontal portion 162 (see FIG. 14) of the handle support 161. The tab 155 urges the pivot 127 into the lowermost position in, the handle support 161 in order that the smaller radius portion 123 of the cam 120 is urged into contact with the follower 113.

Also in position 1, the bottom drawer is in its lower position and all the drawers rest on the frame runners 24 and are free to move in and out of the frame.

Rotation (and the associated storage unit lifting and locking) of the carrying handle assembly 11 occurs in three stages. In the first stage, the handle is rotated away from the horizontal position at the back of the lid 30 (position 1) towards the vertical carrying position. The smaller radius portion 123 of each cam rotates in contact with each cam follower.

As the handle assembly 11 is rotated through stage one, the attached lid locking elements 140 rotate with the rotors 145. The projection 165 on each rotor 145 is forced out of the nodules and, as the slots 152, 153 move out of alignment, the lid locking elements 140 become trapped between their respective rotor 145 and arm 9. Contact between the tab 155 and the lower surface of the horizontal portion 162 of the handle support 161, ensures that the working surface of each cam is urged into contact with the respective cam followers as the handle rotates. Stage 1 ends where the corner of the flat surface 122 of each cam 120 contacts the cam follower 113.

In the second stage of handle rotation, the cam rotates so that the larger radius portion 121 of the cam contacts the cam follower 113 as the handle is rotated to the vertical position suitable for carrying the storage unit (position 2).

Between positions one and two, the handle assembly is lifted relative to the lid 30 and the pivot 127 on each handle arm 117 slides upwards in the respective handle support 161. As the handle assembly is raised, the lid locking elements 140, trapped at each side of the storage unit between the rotor and arm, lift the arms and thereby lift the bottom drawer and the drawers resting on it into their locked positions with the drawer runners 50 behind the respective locking detents 19 into the upper or locked position.

In the third stage of handle rotation, the handle is rotated to a horizontal position at the front of the lid (position 3). Between positions two and three, the larger radius portion of the cam remains in contact with the cam follower. No vertical motion of the drawer locking assembly therefore occurs during this stage and the cam is simply locked in an over dead centre position to prevent the handle from rotating back to the unlocked position during transit of the storage unit. The drawer runners 25 remain blocked behind detents 19 and the drawers remain locked.

A handle locking means is provided to lock the handle in position 3. Holes 130, 131 are provided in the top and a side surface of the lid 30 (see FIG. 11) through which the hoop of a padlock can be passed. When locked, the body of the padlock is positioned above the handle arm 117 on the corresponding side of the lid to prevent the handle from being rotated to unlock the drawers.

Figure 15A:
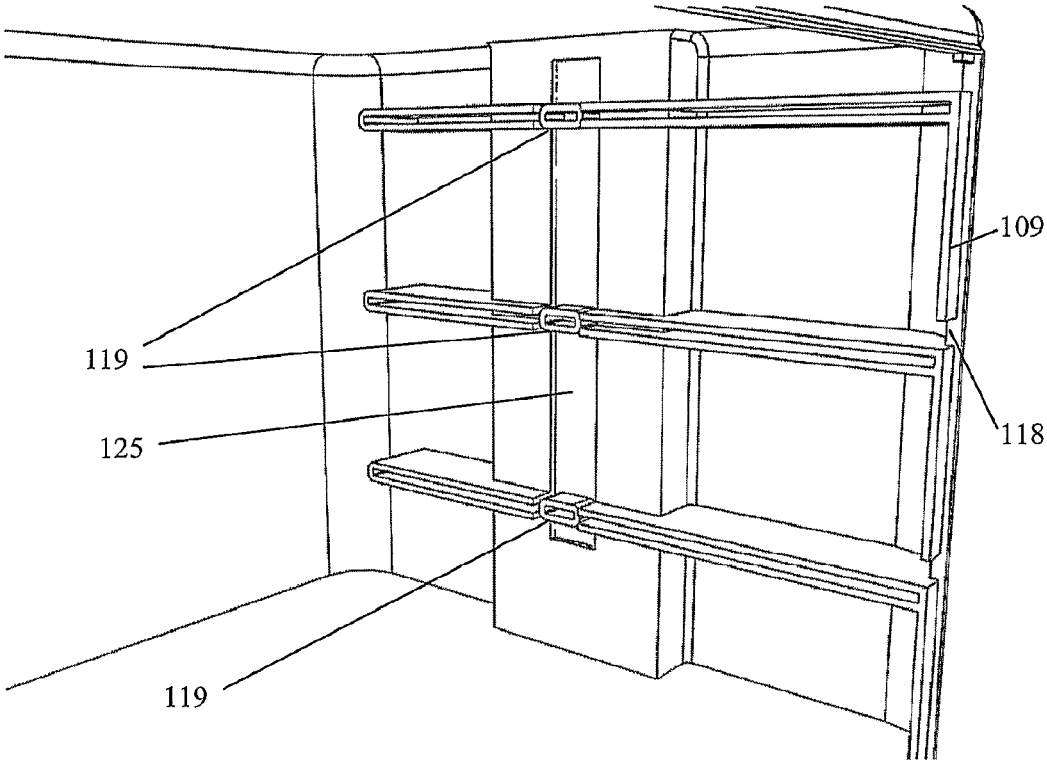
FIG. 15*a* is a perspective view of an embodiment of the invention in its second aspect illustrating the storage unit from inside the frame with the drawer locking slide in the unlocked position.
Figure 15B:
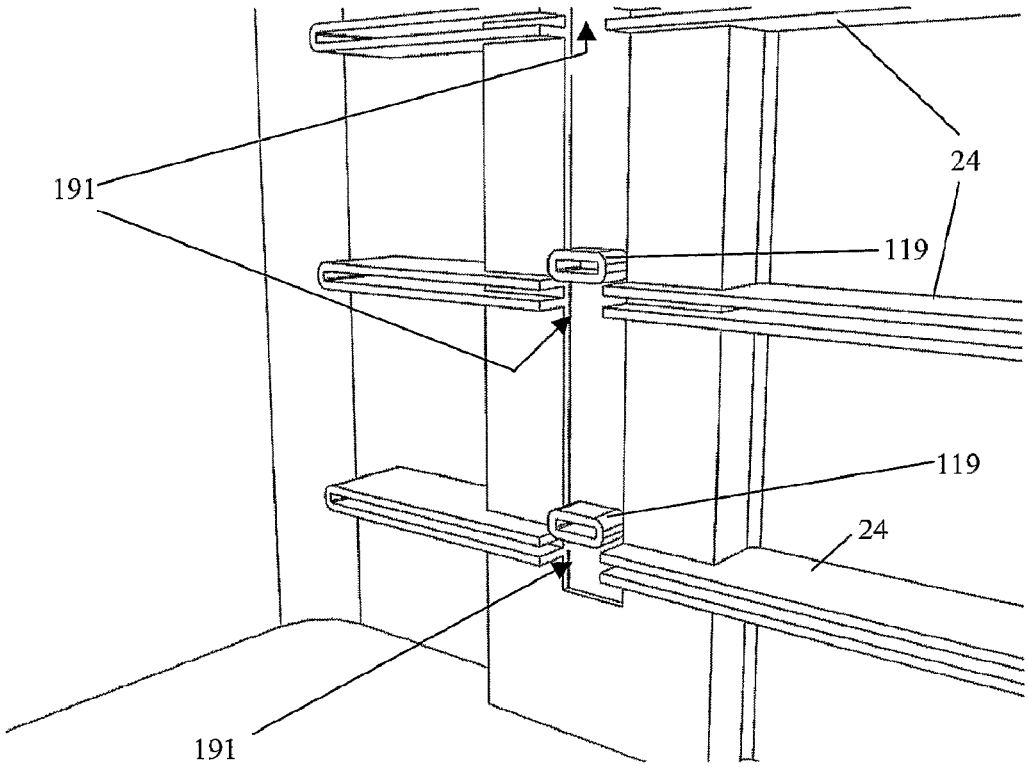
FIG. 15*b* is a perspective view of the storage unit of FIG. 15*a* from inside the frame with the drawer locking slide in the locked position.

In a further alternative embodiment of the invention (see FIGS. 15*a* and 15*b*), the storage unit is identical to that described above with reference to FIGS. 6 to 14 except that rather than arms 9 linked to the bottom drawer being displaced by movement of the handle assembly, locking slides 125 including detents 119 are provided. The drawer locking slides 125, like the arms 9 of FIGS. 6 to 14, are slidably located in channels 102 (of the type shown in FIG. 12). In a manner similar to that described above for the embodiment illustrated in FIGS. 6 to 14, movement of the handle 11 moves locking slides 125 up and down.

The locking slides 125 are identical at their upper end to the arms 9. They differ in that the locking slides do not have projections or runners for engaging or lifting the bottom drawer. Instead the locking slide includes a series of detents 119 for engaging each drawer.

In handle position 1 discussed above for the embodiment of FIGS. 6 to 14, detents 119 (see FIGS. 15*a* and 15*b*) provided on the drawer locking slides 125 are aligned with slots 191 in the frame runners 24. The drawers can be moved between the open and closed positions, unhindered by the detents 119 on the drawer locking slides 125.

When the handle is rotated to position 2 (as discussed above for the embodiment of FIGS. 6 to 14) to raise the drawer locking slides, the detents 119 are lifted out of alignment with the slots 191 in the frame runners 24 and therefore block movement of the drawer runners 25 along the frame runners 24. This locks the drawers 3 in the closed position within the frame.

When the handle is rotated to position 3 (as discussed above for the embodiment as FIGS. 6 to 14) to lock the cams in an over dead centre position, the detents 19 remain out of alignment with the slots 219 in the drawer runners 25 and the drawers 3 remain locked.

The handle assembly 11 can only be rotated from position 1 to position 2 to lock the drawers 3 and lift the storage unit, if the drawers are in the closed position within the frame. If any of the drawers is open, the drawer runners 25 will prevent movement of the drawer locking slides 125 from the unlocked position to the locked position by blocking movement of the detents 119. The drawers 3 must therefore be moved into the closed position before the storage unit can be locked and lifted by the carrying handle assembly 11.

As described above movement of the handle assembly may be used to lift a drawer locking slide relative to the drawers to lock the drawers in the closed position or, to lift the drawers relative to the frame to lock the drawers or drawer runners behind detents in the frame. For each of the embodiments described, only one of these two possibilities is described. However, it is possible in each described embodiment to replace arms linked to the bottom drawer with a drawer locking slide or vice versa.

Figure 16A:
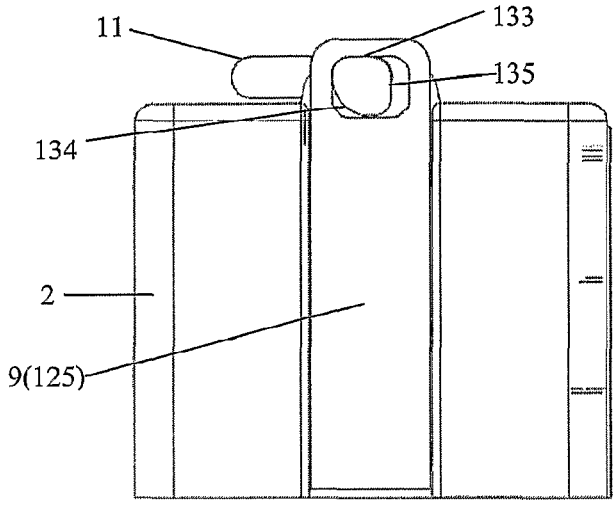
FIG. 16*a* is a side view of a further embodiment of the invention with the handle at the rear of the unit in the unlocked position.
Figure 16B:
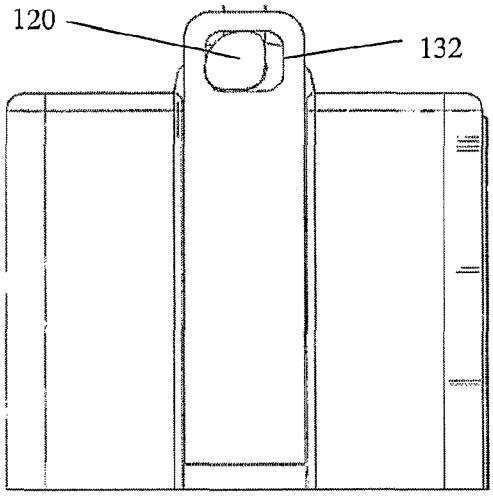
FIG. 16*b* is a side view of the storage unit of FIG. 16*a*, with the handle in the vertical carrying position.
Figure 16C:
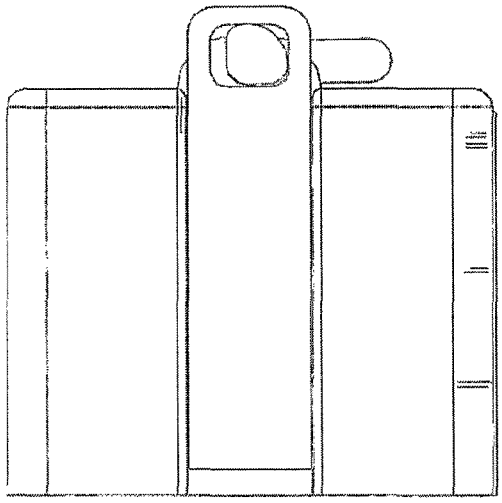
FIG. 16*c* is a side view of the storage unit of FIG. 16*a*, with the handle at the front of the unit in a fully locked position.

In a further embodiment of the invention (see FIGS. 16*a* to 16*c*), a cam 120 is directly connected to each handle arm 9 (or alternatively to a locking slide 125).

The handle assembly rotates inside fixed pivots attached to the frame. The cam follower is attached directly to the arm 9 or drawer locking slide 125 instead of being attached to the frame of the storage unit. As a result, rotation of the handle cams does not effect lifting of the handle assembly relative to the frame but only lifting of the arm 9 or locking slide 125.

The cams 120 are arranged to rotate inside apertures 132 in the arm 9 (or locking slide 125). The working surface of each cam is in contact with the inside upper surface of the aperture which forms a cam follower.

Each cam 120 has a curved portion 134 and two straight portions 133, 135. In position 1, (FIG. 16*a*) straight portion 133 of each cam 120 supports the cam follower and arm 9 or drawer locking slide 125 in the lower or unlocked position. Rotation of the handle assembly from position 1 to position 2 (FIG. 16*b*) rotates each cam 120 so that curved portion 134 is in contact with the respective cam follower. This lifts the arms 9 or drawer locking slides 125 in their respective channels in the frame.

Further rotation of the handle 11 from position 2 to position 3 (see FIG. 16*c*) moves the cam to an over dead centre position to prevent the handle from rotating in the opposite direction to unlock the drawers when the storage unit is not in use.

In yet a further embodiment of the invention (see FIGS. 17*a*, 17*b*), a cam follower 113 is urged away from the frame by a resilient means 90 such as a spring or rubber block. Cams 120 have two curved portions of different radii.

Figure 17A:
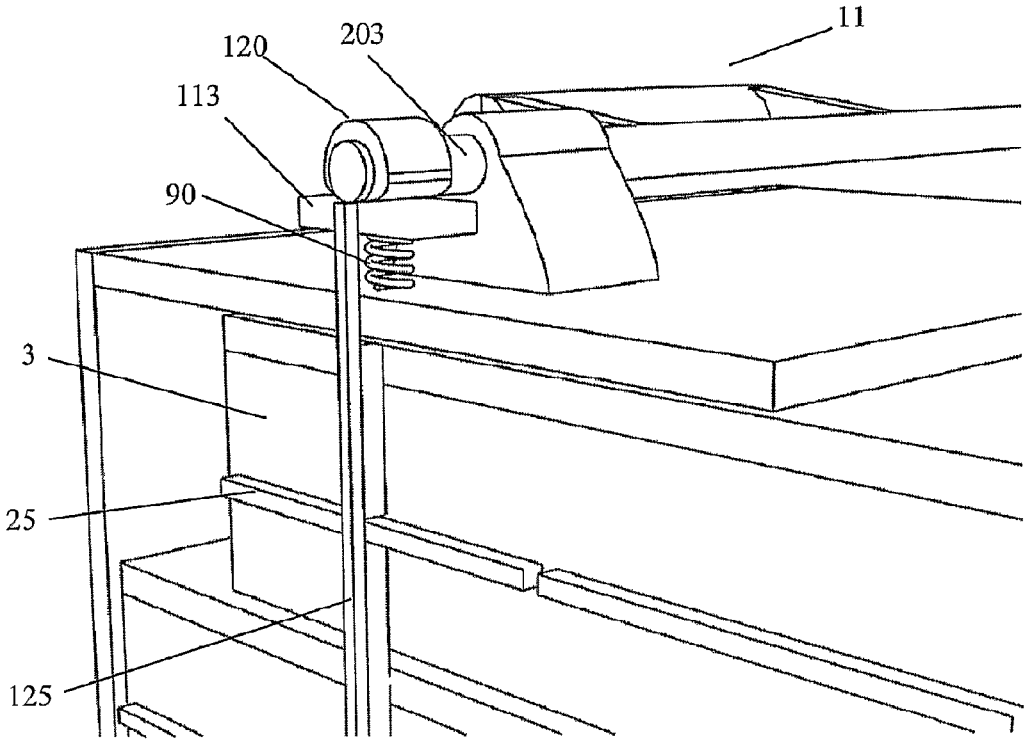
FIG. 17*a* is a side view of the storage unit according to another embodiment of the invention, with the drawer locking mechanism in the unlocked position.
Figure 17B:
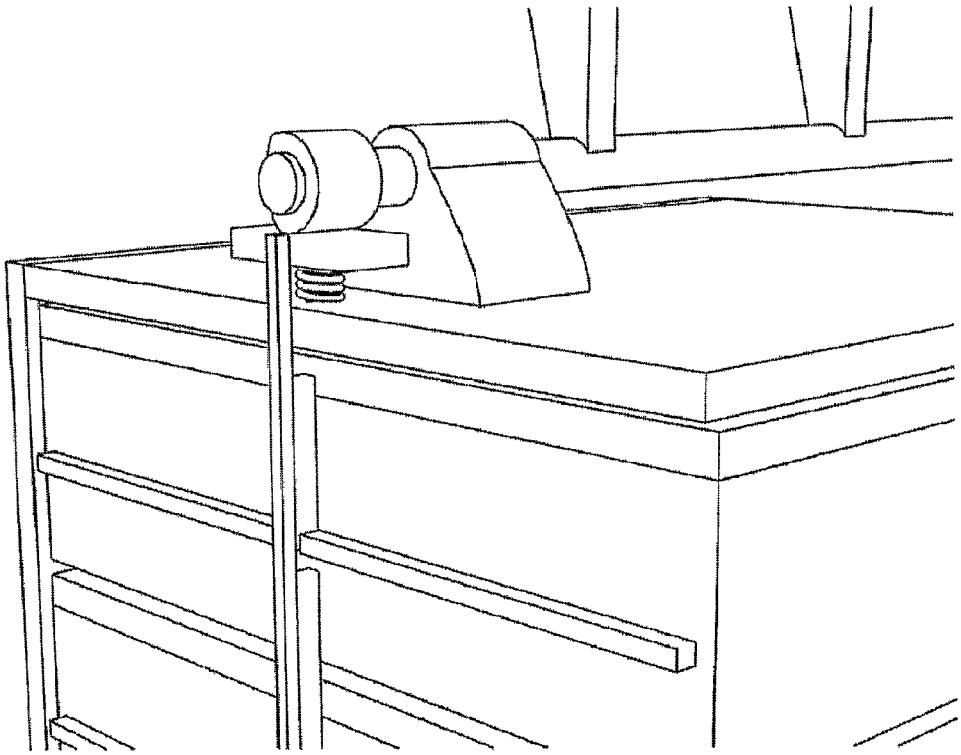
FIG. 17*b* is a side view of the storage unit of FIG. 16*a* with the drawer locking mechanism in the locked position.

The spring 90 urges the drawer locking slide 125 into the unlocked position (FIG. 17*a*). Rotation of the handle assembly 11 from position 1 (FIG. 17*a*) to position 2 (FIG. 17*b*) rotates cams 120 against cam followers 113. When the smaller radius portion of each cam surface contacts the cam follower, the cam followers are urged towards the frame against the action of the spring (FIG. 17*b*). This locks the drawers 3 in the closed position. The structure of the drawers and drawer locking slides is the same as that described in the previous three embodiments.

Rotation of the handle assembly to position 3 (not shown) rotates the cams to an over dead centre position to prevent the drawers from becoming unlocked when the storage unit is not, in use.

In the embodiments described above, all the storage units are easily portable three-drawer units with carrying portable handles. A storage unit 1 according to the present invention may also take the form of a module of a larger storage chest.

Figure 18A:
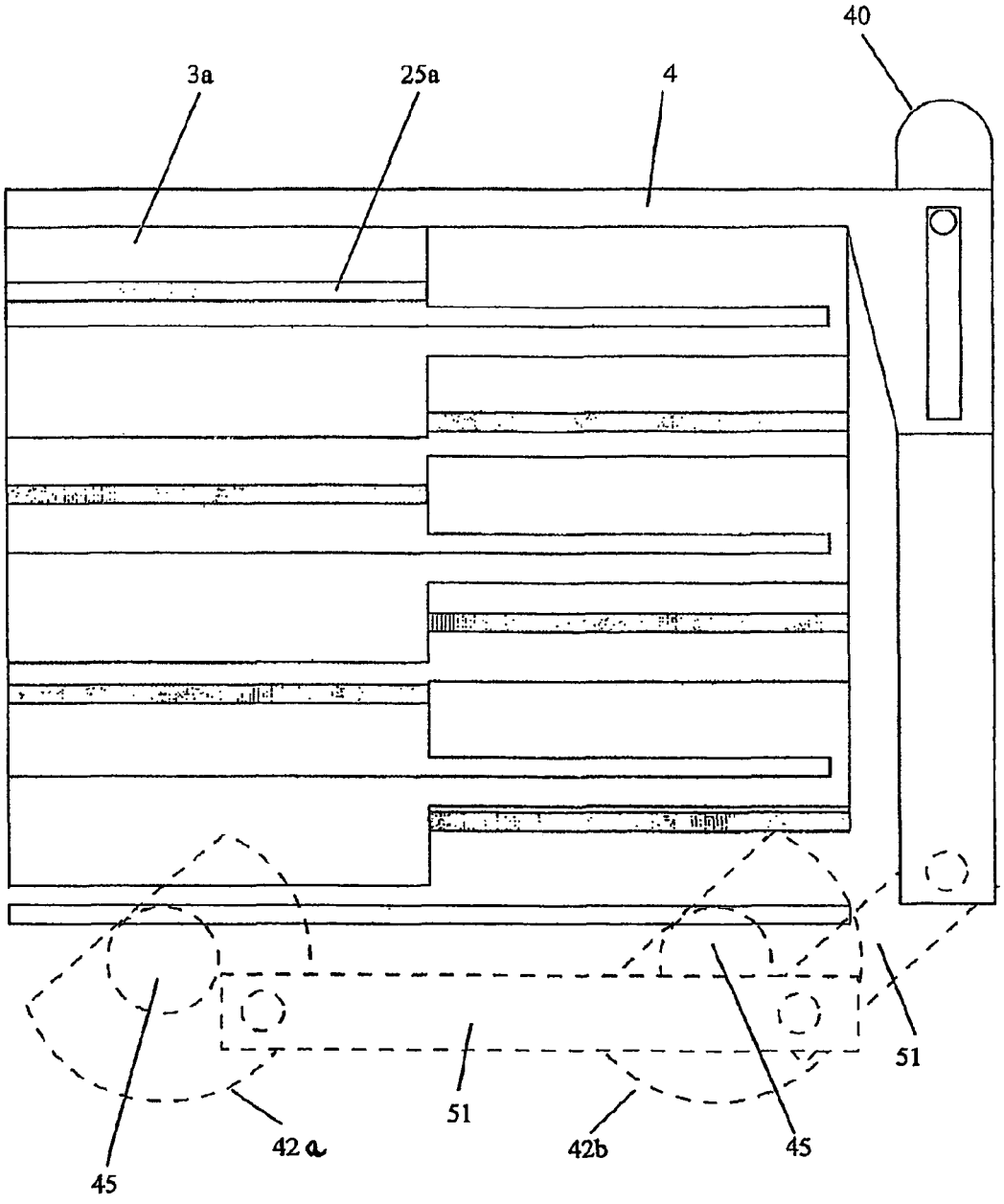
FIGS. 18*a* and 18*b* illustrate an embodiment of the invention in which movement of the drawers is effected by a cam arrangement at the bottom of the unit.
Figure 18B:
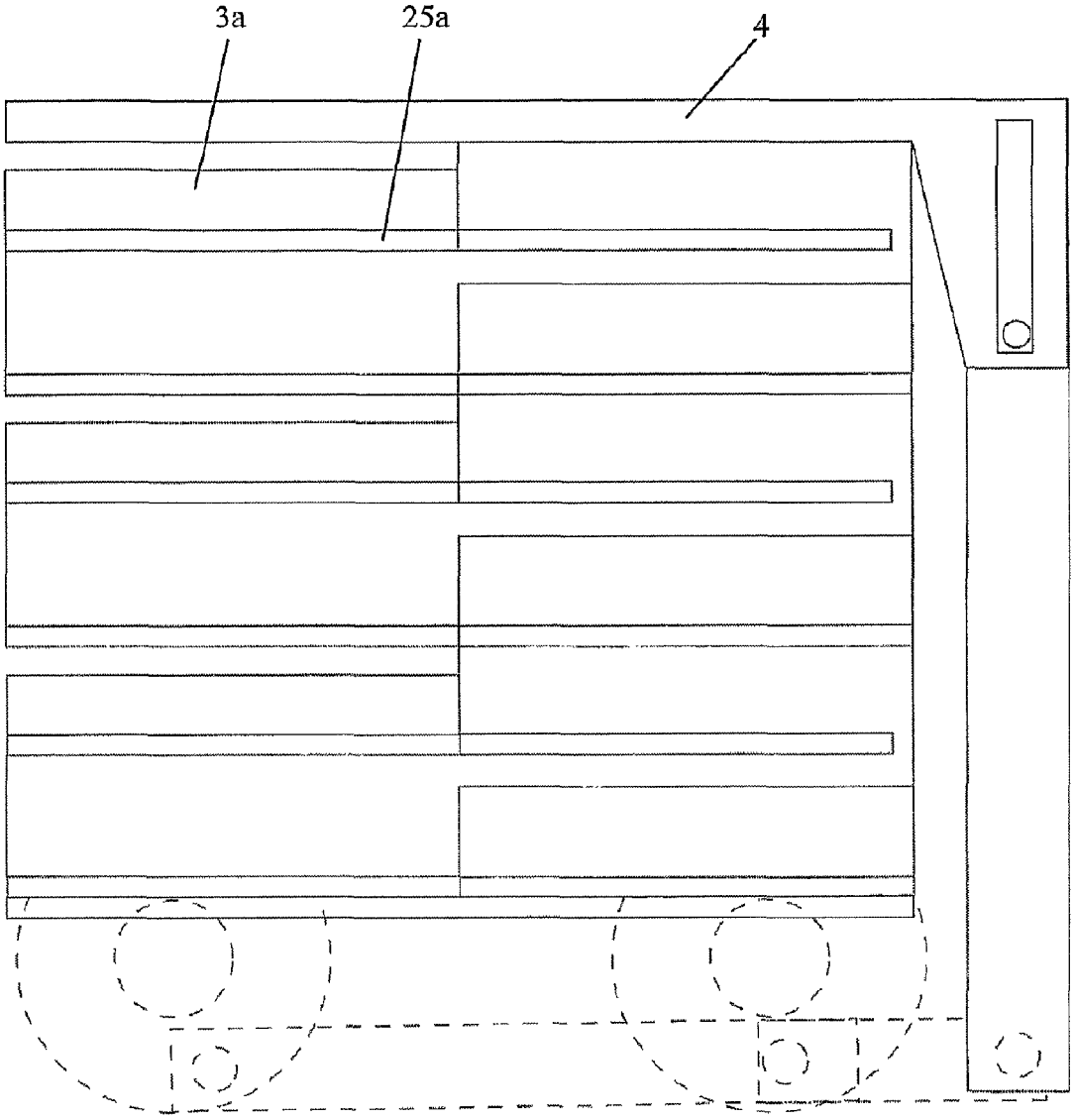

The embodiments described above having cam arrangements for either lifting a drawer or moving a drawer locking slide all have cam arrangements at the top of the unit. It is also possible to provide a mechanism with the cam arrangements at the bottom of the unit. The unit of FIGS. 18*a* and 18*b* may be supported upon wheels and a leg arrangement (not shown). In FIGS. 18*a* and 18*b*, the displacement required to lift a drawer or drawer locking slide is by releasing a button 40 in the handle that engages the closing mechanism. In this way, a user can move the chest around on the wheels from one place to another knowing that the drawers are held in the closed configuration. The handle may be telescopic to allow for easy towing of the unit. Preferably, the closing mechanism (which may be a cam system as shown in FIGS. 18*a*, 18*b*, (but could also be a lever system or a gear system) is automatically engaged when a force is applied to the handle or when the handle moves through an angle away from the body of the unit, as happens when the unit is being towed. The closing mechanism shown in FIGS. 18*a* and 18*b* includes two cams 42*a* and 42*b* which are rotated about pivots 45 via a series of rods 51 connected to the button 40.

To bring the drawers into the open configuration, the handle Is moved to a position that allows the drawers to disengage. In FIG. 18*b*, the button 40 is depressed to rotate the cams 42*a*, 42*b* such that the drawers are allowed to fail.

All the embodiments described above include drawers which run on runners or rails which are fixed on the inside of the frame. It is, however, possible to also have extendable runners which can themselves be pulled out of the frame so that the drawer or drawers can be pulled further out of the frame. In effect an extendable runner (on which the drawer may slide itself) slides on rails or runners fixed to the frame. In embodiments of the invention (not shown in figures) having extendable runners, relative movement of the closed drawer perpendicular to the opening and closing direction of the drawer, and looking, may be achieved in much the same way as discussed above for inextendable runners. In other words, by connection of a moving handle to the drawer or frame and by a locking detent or abutment on the frame side wall.

The invention claimed is:

1. A storage unit comprising a frame, a drawer moveable, in a first direction in and out of the frame between a closed position within the frame and an open position in which the drawer projects from the frame, and a manually operable locking control member, and a linkage disposed between the locking control member and the drawer, wherein the drawer is moveable with a clearance between the drawer and either a surface of an element of the frame or a surface of a second drawer and the linkage is arranged to displace the drawer relative to the element of the frame or the surface of a second drawer, and wherein actuation of the linkage by the locking control member displaces the drawer relative to the element of the frame or the surface of a second drawer to effectively eliminate or reduce the clearance and lock the drawer in the closed position.

2. A storage unit according to claim 1, having at least one further drawer adjacent the first mentioned drawer to form a stack of drawers, with clearances between adjacent ones of the drawers, wherein the linkage is arranged to act on the lowest one of the drawers to eliminate or reduce the clearances in the closed and locked position of the drawers.

3. A storage unit according to claim 1, wherein the locking control member is a carrying handle moved to a locking position when used to carry the storage unit.

4. A storage unit according to claim 3, wherein the linkage includes an arm, and the handle is secured to the arm, the arm being slidably guided for vertical movement in the frame and acting on the drawer to displace the drawer relative to the element of the frame or the surface of a second drawer.

5. A storage unit according to claim 4, wherein the handle includes a handle arm pivotally connected at a pivot to the arm acting on the drawer, the handle arm being formed with a configuration to move the arm vertically on rotation of the handle.

6. A storage unit according to claim 1, wherein the linkage includes runners for supporting the drawer.

7. A storage unit according to claim 1, wherein the frame includes a detent or blocking element which blocks movement of the drawer in the first direction when the drawer is in the closed position.

8. A storage unit according to claim 5, wherein the handle and arm are coupled by a cam arrangement including a cam connected to the handle arm and rotatable therewith, and a cam follower attached to the frame, and wherein the pivot is capable of linear movement inside a handle support and is arranged so that pivotal movement of the cam against the cam follower moves the pivot inside the handle support such that the handle and arm are moved relative to the frame.

9. A storage unit according to claim 5 wherein the handle and arm are coupled by a cam arrangement including a cam connected to the handle arm and rotatable therewith, and a cam follower is connected to the arm, and the pivot is fixed relative to the storage unit so that pivotal movement of the handle about the fixed pivot moves the arm linearly relative to the storage unit.

10. A storage unit according to claim 1, further comprising a lid mounted on a top of the unit and moveable between a first closed position and a second open position which allows access to a compartment in the top of the unit, a lid locking element for selectively locking the lid, the locking control member including a handle moveable between a first position which allows access to the compartment and a second carrying position, and the handle and the lid locking element are linked such that movement of the handle into the second carrying position locks the lid.

11. A storage unit according to claim 10 wherein the lid locking element has a non-circular cross-section and the handle includes a grip element and a handle arm pivotally attached to a the lid such that when the lid is moved to the first closed position, the lid locking element attached to the handle arm is engaged with a recess in a rotor supported by the linkage, such that rotation of the handle traps the lid locking element between the rotor and the linkage to lock the lid.

12. A storage unit according to claim 9, wherein the cam follower is the upper inside surface of an aperture in the arm and the cam rotates inside the aperture.

13. A storage unit according to claim 9 wherein the cam follower is connected to the arm such that the cam follower is moved away from the frame by rotation of the cam.

14. A storage unit comprising a frame, a drawer moveable, in a first direction in and out of the frame between a closed position within the frame and an open position in which the drawer projects from the frame, a locking control member for selectively locking the drawer in the closed position, and a linkage between the locking control member and the drawer for displacing the drawer relative to the frame, wherein the locking control member is a carrying handle moved to a locking position when used to carry the storage unit and the linkage includes an arm, the handle being secured to the arm, and the arm being slidably guided for vertical movement in the frame and acting on the drawer, and the handle includes a handle arm pivotably connected at a pivot to the arm acting on the drawer, the handle arm being formed with a configuration to move the arm vertically on rotation of the handle.

15. A storage unit comprising a frame, a drawer moveable, in a first direction in and out of the frame between a closed position within the frame and an open position in which the drawer projects from the frame, and a locking control member for selectively locking the drawer in the closed position, and a linkage between the locking control member and the drawer for displacing the drawer relative to the frame, a lid mounted on a top of the unit and moveable between a first closed position and a second open position which allows access to a compartment in the top of the unit, a lid locking element for selectively locking the lid, the locking control member including a handle moveable between a first position which allows access to the compartment and a second carrying position, and the handle and the lid locking element are linked such that movement of the handle into the second carrying position locks the lid.

16. A storage unit according to claim 15, wherein the lid locking element has a non-circular cross-section and the handle includes a grip element and a handle arm pivotally attached to the lid such that when the lid is moved to the first closed position, the lid locking element attached to the handle arm is engaged with a recess in a rotor supported by the linkage, such that rotation of the handle traps the lid locking element between the rotor and the linkage to lock the lid.

17. A storage unit according to claim 1, wherein the clearance between the drawer and either a surface of an element of the frame or a surface of a second drawer is a generally vertical clearance, the drawer is arranged to move generally horizontally into and out of the frame between the closed and open positions, and the locking control member is arranged to actuate the linkage to displace the drawer and eliminate or reduce the generally vertical clearance and lock the drawer in the closed position.

18. A storage unit comprising:

a frame;

a drawer supported on said frame for movement in a first direction into and out of said frame between a closed position wherein said drawer is disposed within said frame and an open position wherein said drawer projects outwardly from said frame, said drawer being supported on said frame so as to define a clearance between said drawer and another adjacent drawer or between said drawer and said frame;

a locking control member for selectively locking said drawer in the closed position; and a linkage operatively connecting said locking control member and said drawer such that manipulation of said locking control member actuates said linkage and said linkage displaces said drawer in a second direction transverse to the first direction relative to said frame or another adjacent drawer to reduce the clearance and lock said drawer in the closed position.

19. A storage unit according to claim 18, wherein said locking control member comprises a carrying handle and said linkage comprises a pair of arms disposed on opposite sides of said unit and respectively connected to opposite end portions of said handle, said arms being vertically movable relative to said frame and disposed to act on said drawer to displace said drawer in the second direction.

* * * * *